US010405654B2

(12) United States Patent
Chen et al.

(10) Patent No.: US 10,405,654 B2
(45) Date of Patent: Sep. 10, 2019

(54) DRIVING MECHANISM, PROTECTION DEVICE AND CONTROL METHOD APPLICABLE TO FURNITURE

(71) Applicants: KING SLIDE WORKS CO., LTD., Kaohsiung (TW); KING SLIDE TECHNOLOGY CO., LTD., Kaohsiung (TW)

(72) Inventors: Ken-Ching Chen, Kaohsiung (TW); Hsiu-Chiang Liang, Kaohsiung (TW); Chun-Chiang Wang, Kaohsiung (TW)

(73) Assignees: KING SLIDE WORKS CO., LTD., Kaohsiung (TW); KING SLIDE TECHNOLOGY CO., LTD., Kaohsiung (TW)

( * ) Notice: Subject to any disclaimer, the term of this patent is extended or adjusted under 35 U.S.C. 154(b) by 97 days.

(21) Appl. No.: 15/822,193

(22) Filed: Nov. 26, 2017

(65) Prior Publication Data

US 2018/0332963 A1 Nov. 22, 2018

(30) Foreign Application Priority Data

May 16, 2017 (TW) ..... 106116386 A

(51) Int. Cl.
*A47B 88/463* (2017.01)
*A47B 88/477* (2017.01)

(52) U.S. Cl.
CPC ..... *A47B 88/463* (2017.01); *A47B 88/477* (2017.01)

(58) Field of Classification Search
CPC ..... A47B 88/46; A47B 88/463; A47B 88/467; A47B 88/473; A47B 88/477
USPC ..... 312/333
See application file for complete search history.

(56) References Cited

U.S. PATENT DOCUMENTS 7,374,261 B1 * 5/2008 Wang ..... A47B 88/463 312/319.1
8,172,345 B2 5/2012 Liang
8,308,251 B2 * 11/2012 Liang ..... A47B 88/463 312/319.1
8,590,989 B2 * 11/2013 Lowe ..... A47B 88/047 312/319.1

(Continued)

FOREIGN PATENT DOCUMENTS

JP 2007-252491 A 10/2007
JP 2016-514575 A 5/2016

(Continued)

*Primary Examiner* — Daniel J Rohrhoff
(74) *Attorney, Agent, or Firm* — Winston Hsu

(57) ABSTRACT

A driving mechanism includes an open elastic member, an actuating member and a protection device. When a second furniture part is moved relative to a first furniture part from a closed position to an over-push position along a first direction, the open elastic member is configured to provide an opening force to drive the second furniture part to move to an open position along a second direction. The protection device includes a blocking member and a control member. During a process of the second furniture part being moved from the open position to the closed position along the first direction, the blocking member is moved from a first state to a second state to be blocked by the actuating member, in order to prevent the second furniture part from being moved from the closed position to the over-push position.

16 Claims, 22 Drawing Sheets

(56) References Cited

U.S. PATENT DOCUMENTS

| | | | | |
|---|---|---|---|---|
| 2007/0090735 | A1* | 4/2007 | Hashemi | A47B 88/463 312/334.46 |
| 2008/0169741 | A1* | 7/2008 | Jurja | A47B 88/463 312/319.1 |
| 2008/0191592 | A1 | 8/2008 | Dubach | |
| 2011/0175508 | A1* | 7/2011 | Rechberg | E05F 3/108 312/334.8 |
| 2013/0004101 | A1* | 1/2013 | Chen | A47B 88/463 384/10 |
| 2015/0091424 | A1* | 4/2015 | Nuckolls | A47B 88/433 312/319.1 |
| 2017/0051813 | A1* | 2/2017 | Karu | E05F 1/16 |
| 2017/0086583 | A1 | 3/2017 | Chen | |
| 2017/0135480 | A1* | 5/2017 | Chen | F16H 19/04 |
| 2017/0280872 | A1* | 10/2017 | Chen | A47B 88/46 |

FOREIGN PATENT DOCUMENTS

| | | | |
|---|---|---|---|
| WO | 2013/073489 | A1 | 5/2013 |
| WO | 2017/004639 | A1 | 1/2017 |

* cited by examiner

DRIVING MECHANISM, PROTECTION DEVICE AND CONTROL METHOD APPLICABLE TO FURNITURE

BACKGROUND OF THE INVENTION

1. Field of the Invention

The present invention relates to a driving mechanism and a protection device, and more particularly, to a driving mechanism, a protection device and a control method for a furniture system.

2. Description of the Prior Art

U.S. Pat. No. 8,172,345 B2 discloses a self-moving device for movable furniture parts capable of assisting a drawer at a close position in opening relative to a cabinet (so-called push-open function), and capable of assisting the drawer in self-closing during an end process of the drawer moving from an open position to a retracted position (so-called self-close function). In addition, U.S. Pat. No. 8,308,251 B2 also discloses a design capable of adjusting push-open strength. The two cases are provided for reference.

However, when a force applied by a user for closing the drawer from the open position is too strong or the user continues applying the force to push the drawer to move into the cabinet without stopping, the drawer may be further moved to an over-push position after being moved to the close position, such that the drawer is opened again (due to the design of push-open). In order to solve such problem, the present invention is provided.

SUMMARY OF THE INVENTION

The present invention relates to a driving mechanism, a protection device and a control method capable of preventing a second furniture part from being further moved from a close position to an over-push position when the second furniture part is closed relative to the first furniture part from an open position to a close position along a first direction.

According to an embodiment of the present invention, a driving mechanism is applicable to a first furniture part and a second furniture part. The driving mechanism comprises an opening elastic member, an actuating member, and a protection device. The opening elastic member is configured to provide an opening force when the second furniture part is moved relative to the first furniture part from a close position to an over-push position along a first direction, in order to drive the second furniture part to move to an open position along a second direction opposite to the first direction. The protection device is configured to interact with the actuating member. The protection device comprises a base, a blocking member, a control member and an elastic member. The blocking member is mounted to the base and movable between a first state and a second state relative to the base. The control member is mounted to the base and movable between a first control state and a second control state relative to the base. The elastic member is configured to provide an elastic force to the control member and the blocking member. Wherein, during a process of the second furniture part being moved relative to the first furniture part from the open position to the close position along the first direction, the actuating member is configured to drive the control member to move from the first control state to the second control state, and the blocking member is driven by the control member to move from the first state to the second state to be blocked by the actuating member, in order to prevent the second furniture part from being moved from the close position to the over-push position. Wherein, when the control member is moved from the second control state to the first control state, the blocking member is driven by the elastic member to move from the second state to the first state without being blocked by the actuating member, in order to allow the second furniture part to be moved from the close position to the over-push position.

According to another embodiment of the present invention, a protection device is applicable to a furniture system. The protection device comprises a base, a blocking member, a control member and an elastic member. The blocking member is mounted to the base and movable between a first state and a second state relative to the base. The control member is mounted to the base and movable between a first control state and a second control state relative to the base. The elastic member is configured to provide an elastic force to the control member and the blocking member. Wherein, during a process of the protection device being moved relative to an actuating member of the furniture system from a predetermined position to a close position along a predetermined direction, the actuating member is configured to drive the control member to move from the first control state to the second control state, and the blocking member is driven by the control member to move from the first state to the second state to be blocked by the actuating member, in order to prevent the protection device from being moved relative to the actuating member from the close position to an over-push position along the predetermined direction. Wherein, when the control member is moved from the second control state to the first control state, the blocking member is driven by the elastic member to move from the second state to the first state without being blocked by the actuating member, in order to allow the protection device to be moved relative to the actuating member from the close position to the over-push position along the predetermined direction.

According to another embodiment of the present invention, a control method is applicable to the furniture system. The furniture system comprises a first furniture part, a second furniture part and an opening elastic member. The second furniture part is configured to be moved relative to the first furniture part from a close position to an over-push position along a first direction, in order to allow the opening elastic member to release an opening force to drive the second furniture part to move to an open position along a second direction opposite to the first direction. The control method comprises: providing a blocking member and a control member mounted to a base, the blocking member being movable between a first state and a second state relative to the base, the control member being movable between a first control state and a second control state relative to the base; providing an actuating member; moving the blocking member from the first state to the second state to be blocked by the actuating member when the second furniture part is moved from the open position toward the close position along the first direction, in order to prevent the second furniture part from being moved from the close position to the over-push position; and moving the blocking member from the second state to the first state without being blocked by the actuating member a period of delay time after the actuating member drives the control member to move from the second control state to the first control state, in order to allow the second furniture part to be moved from the close position to the over-push position.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
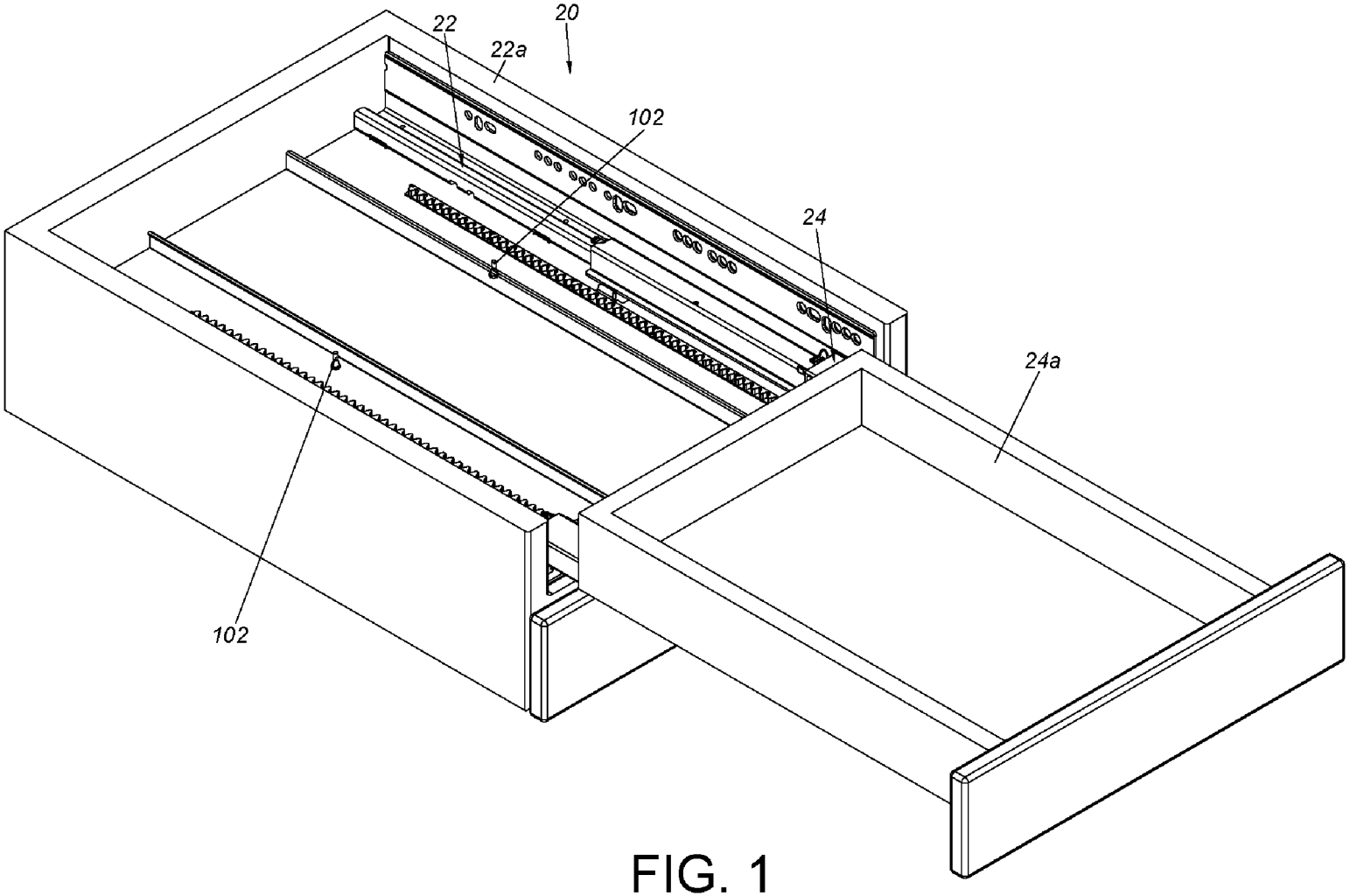
FIG. 1 is a diagram showing a furniture system comprising a cabinet and two drawers according to an embodiment of the present invention.
Figure 2:
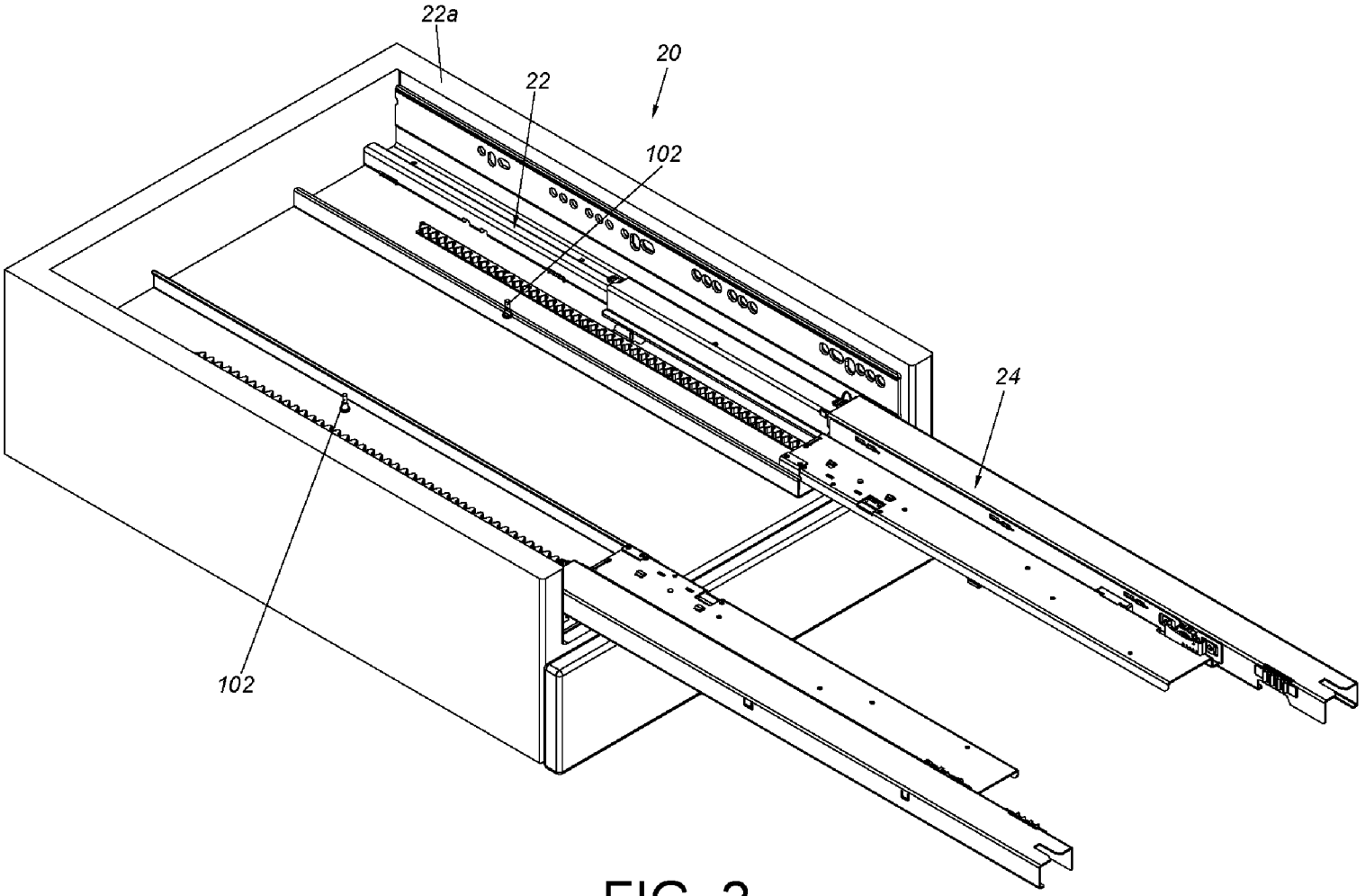
FIG. 2 is a diagram showing the furniture system with removing one of the drawers according to an embodiment of the present invention.

FIG. 1 and FIG. 2 are diagrams showing a furniture system 20 comprising a first furniture part 22 and a second furniture part 24 longitudinally movable relative to the first furniture part 22 according to an embodiment of the present invention. In the present embodiment, the first furniture part 22 is a first rail (such as a fixed rail), and the second furniture part 24 is a second rail (such as a movable rail). Furthermore, the first rail is fixedly mounted to a cabinet 22*a* (the first rail and the cabinet 22*a* can be seen as one component), and the second rail is configured to carry a drawer 24*a* (the second rail and the drawer 24*a* can be seen as one component). However, in other embodiments, the first furniture part 22 and the second furniture part 24 are not limited thereto.

Figure 3:
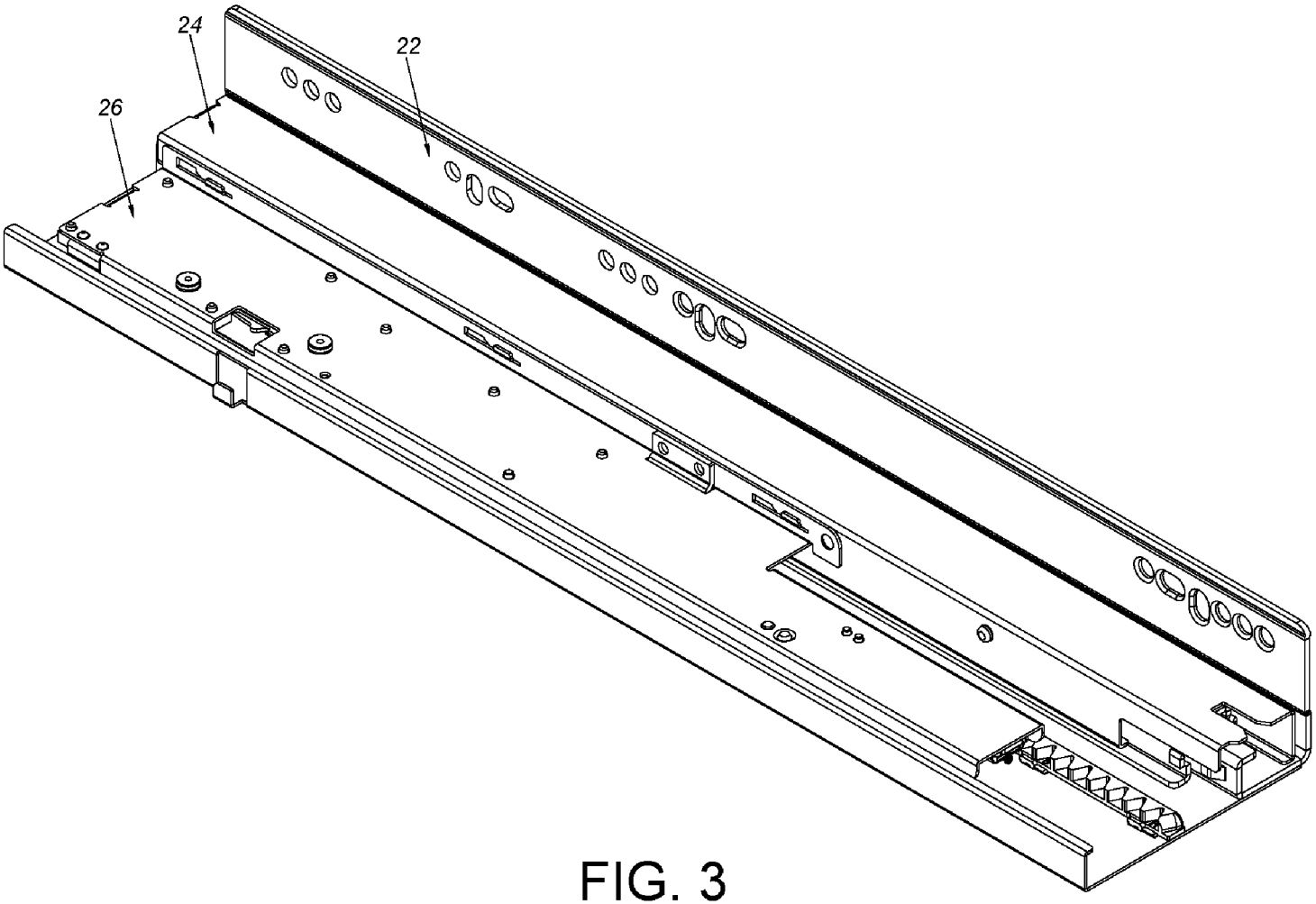
FIG. 3 is a diagram showing the furniture system comprising a first furniture part and a second furniture part according to an embodiment of the present invention, wherein the first furniture part and the second furniture part can be slide rails.

As shown in FIG. 3, the second furniture part 24 is in a retracted state relative to the first furniture part 22. The furniture system 20 further comprises a driving mechanism 26. Preferably, the driving mechanism 26 is arranged on one of the first furniture part 22 and the second furniture part 24. In the present embodiment, the driving mechanism 26 is attached to the second furniture part 24, but the present invention is not limited thereto.

Figure 4:
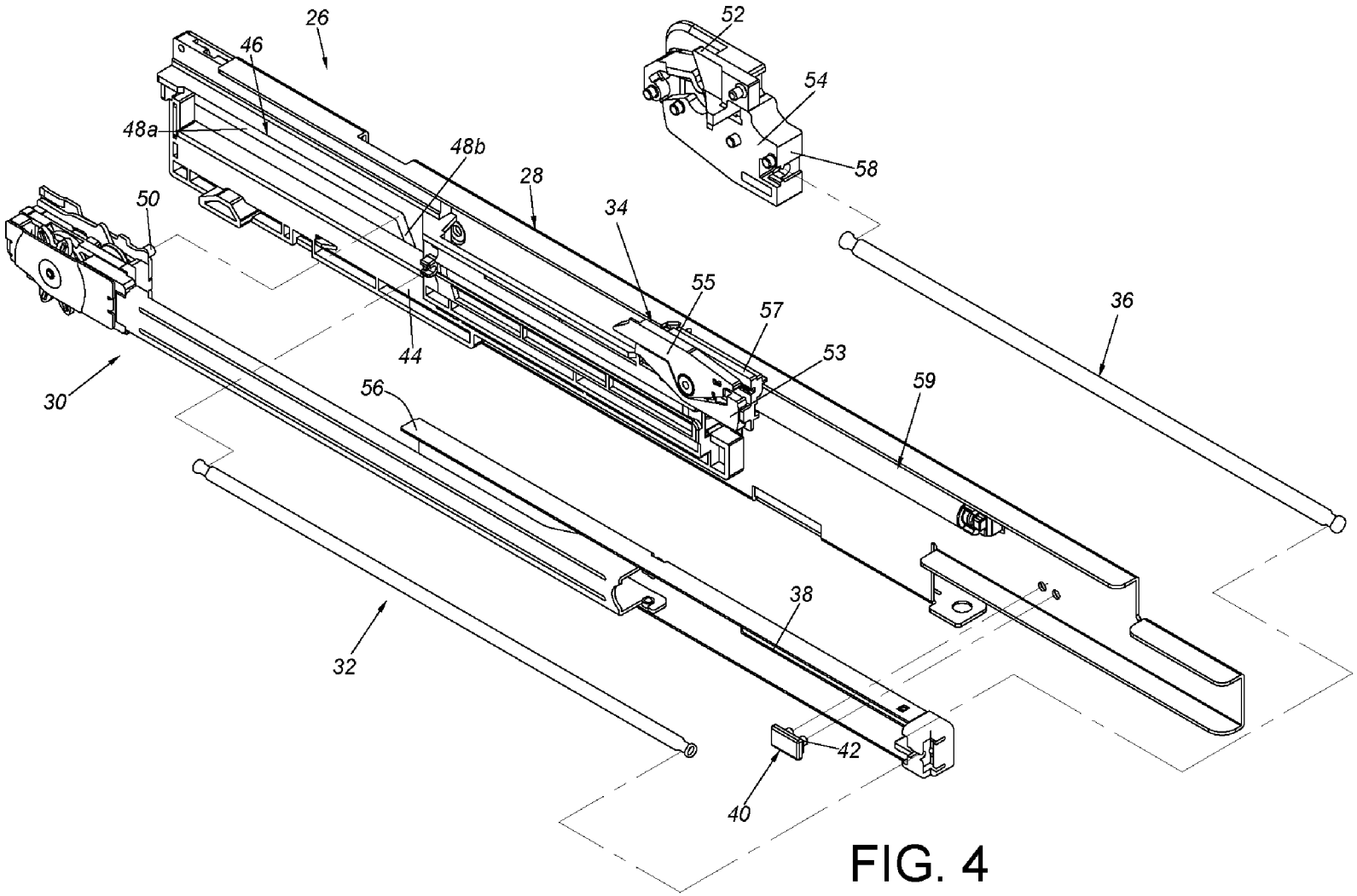
FIG. 4 is an exploded view of a driving mechanism of the furniture system according to an embodiment of the present invention.
Figure 5:
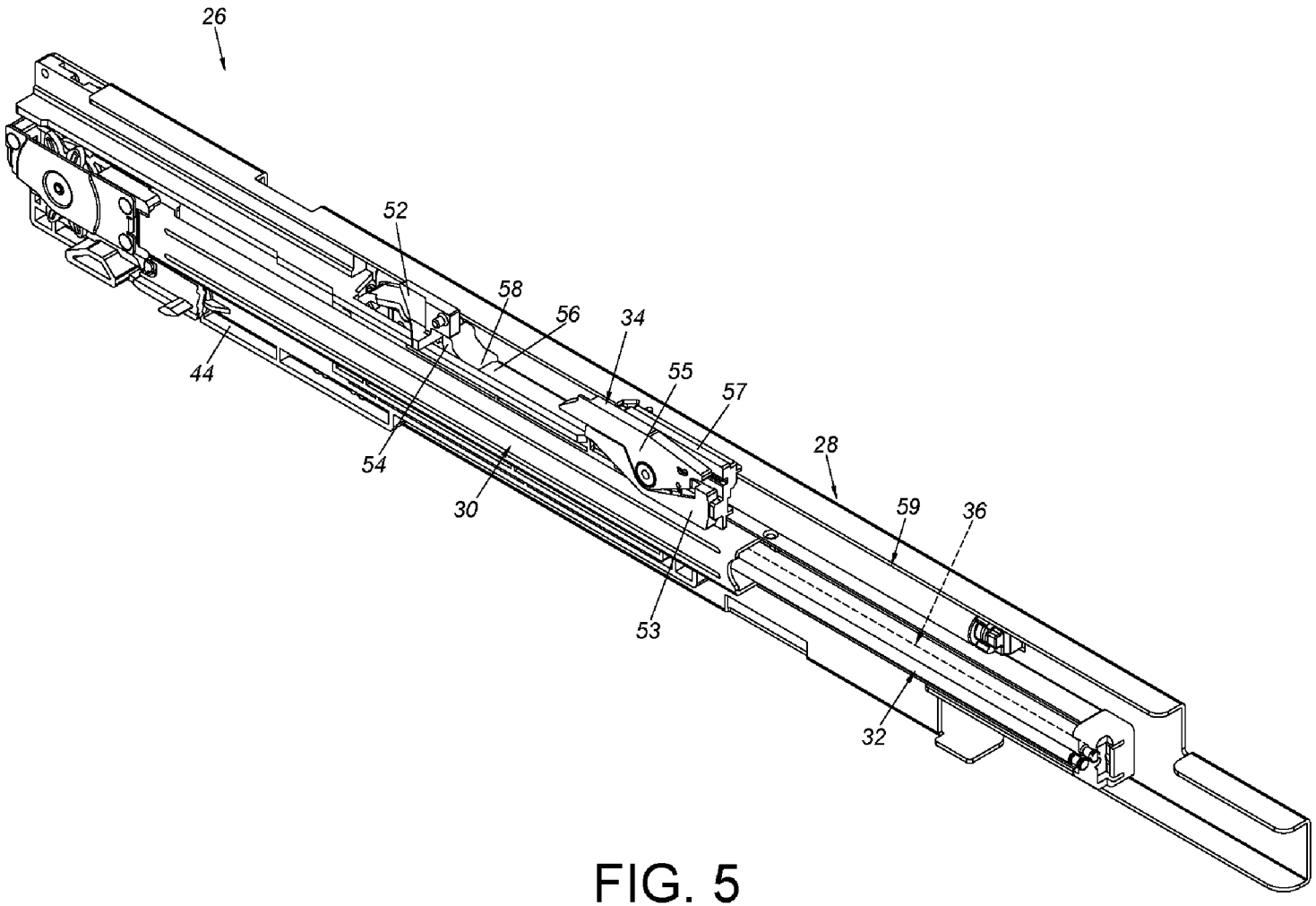
FIG. 5 is a diagram showing the driving mechanism of the furniture system according to an embodiment of the present invention.

As shown in FIG. 4 and FIG. 5, the driving mechanism 26 comprises a first component 28, a second component 30, an open elastic member 32, a protection device 34, a recovery elastic member 36 and an actuating member 52. Preferably, the driving mechanism 26 further comprises a supporting member 54. The supporting member 54 and the actuating member 52 are movable relative to each other.

The first component 28 and the second component 30 are movable relative to each other. For example, one of the first component 28 and the second component 30 has a guiding structure 38. The guiding structure 38 can be a bounded and longitudinally elongated hole. Wherein, a connecting member 40 has at least one connecting part 42 penetrating through a portion of the longitudinally elongated hole, in order to mount the second component 30 to the first component 28, and allow the second component 30 and the first component 28 to be longitudinally movable relative to each other. Preferably, the first component 28 comprises a mounting base 44. The mounting base 44 comprises a first control part 46. The first control part 46 has a first longitudinal section 48*a* and a first bending section 48*b* communicated with the first longitudinal section 48*a* and bent relative to the first longitudinal section 48*a*. On the other hand, the second component 39 is movable in one of the first longitudinal section 48*a* and the first bending section 48*b* through an engaging feature 50. The engaging feature 50 can be an engaging pin.

The open elastic member 32 is elastically connected between the first component 28 and the second component 30. The second component 30 has a first abutting part 56 located at a position corresponding to a second abutting part 58 of the supporting member 54.

The protection device 34 is configured to interact with the actuating member 52. The protection device 34 comprises a blocking member 53 and a control member 55. Preferably, the protection device 34 further comprises a base 57 for mounting the blocking member 53 and the control member 55. The base 57 is attached to the first component 28. For example, the base 57 is fixedly mounted to the first component 28.

The recovery elastic member 36 is elastically connected between the actuating member 52 (and/or the supporting member 54) and the second component 30.

Preferably, the driving mechanism 26 further comprises a damping device 59. The damping device 59 is attached to the first component 28. For example, the damping device 59 is fixed to the first component 28, and the damping device 59 is adjacent to the base 57.

Figure 6:
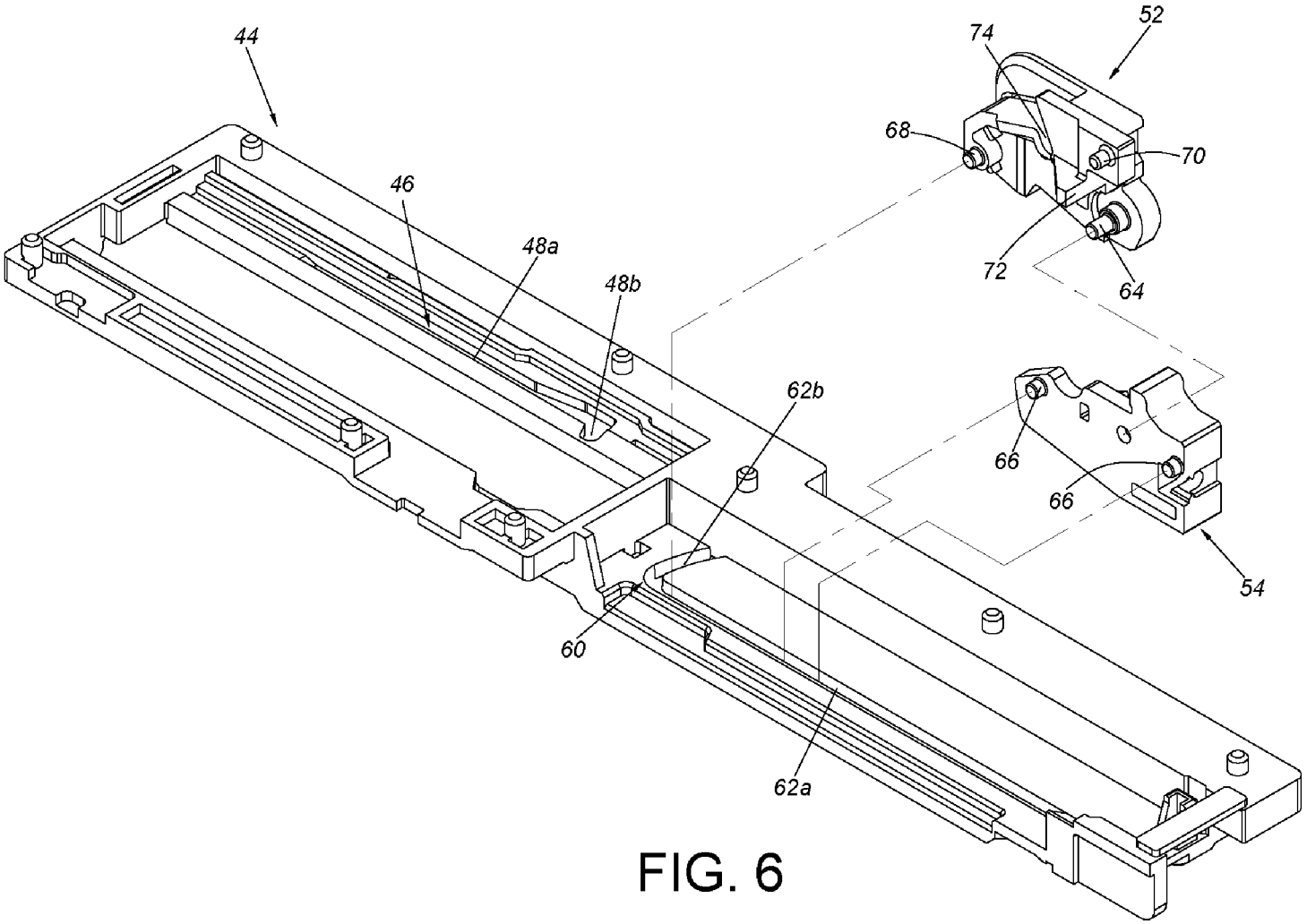
FIG. 6 is an explode view of the driving mechanism according to an embodiment of the present invention.
Figure 7:
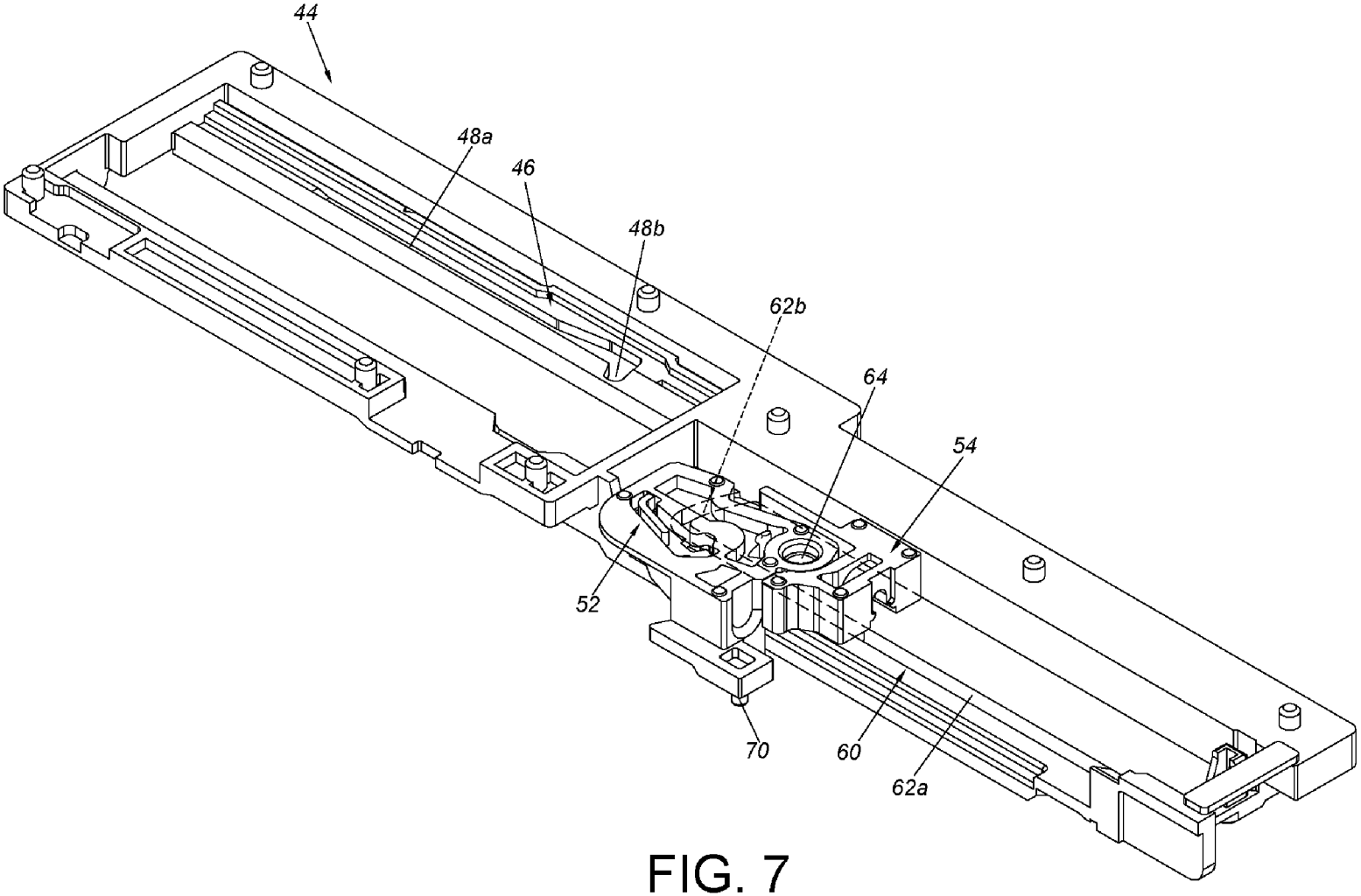
FIG. 7 is diagram showing the driving mechanism according to an embodiment of the present invention.

As shown in FIG. 6 and FIG. 7, in addition to the first control part 46, the mounting base 44 of the first component 28 further comprises a second control part 60. The second control part 60 and the first control part 46 are spaced from each other. Specifically, the second control part 60 has a second longitudinal section 62*a* and a second bending section 62*b* communicated with the second longitudinal section 62*a* and bent relative to the second longitudinal section 62*a*. On the other hand, the actuating member 52 and the supporting member 54 are pivoted to each other by a pivoting feature 64 (such as a pin member). Preferably, the supporting member 54 has at least one first supporting leg 66, and the at least one first supporting leg 66 is located at a position corresponding to the second longitudinal section 62*a* of the second control part 60. On the other hand, the actuating member 52 has a second supporting leg 68, and the second supporting leg 68 can be located at a position corresponding to the second longitudinal section 62*a* of the second control part 60. Preferably, the actuating member 52 comprises a first guiding feature 70 and a blocking feature 72 separated from each other. In the present embodiment, the first guiding feature 70 can be a protrusion, and the blocking feature can be a wall with a predetermined height. Preferably, the actuating member 52 further comprises a catching part 74. For example, the catching part 74 is a hook.

Figure 8:
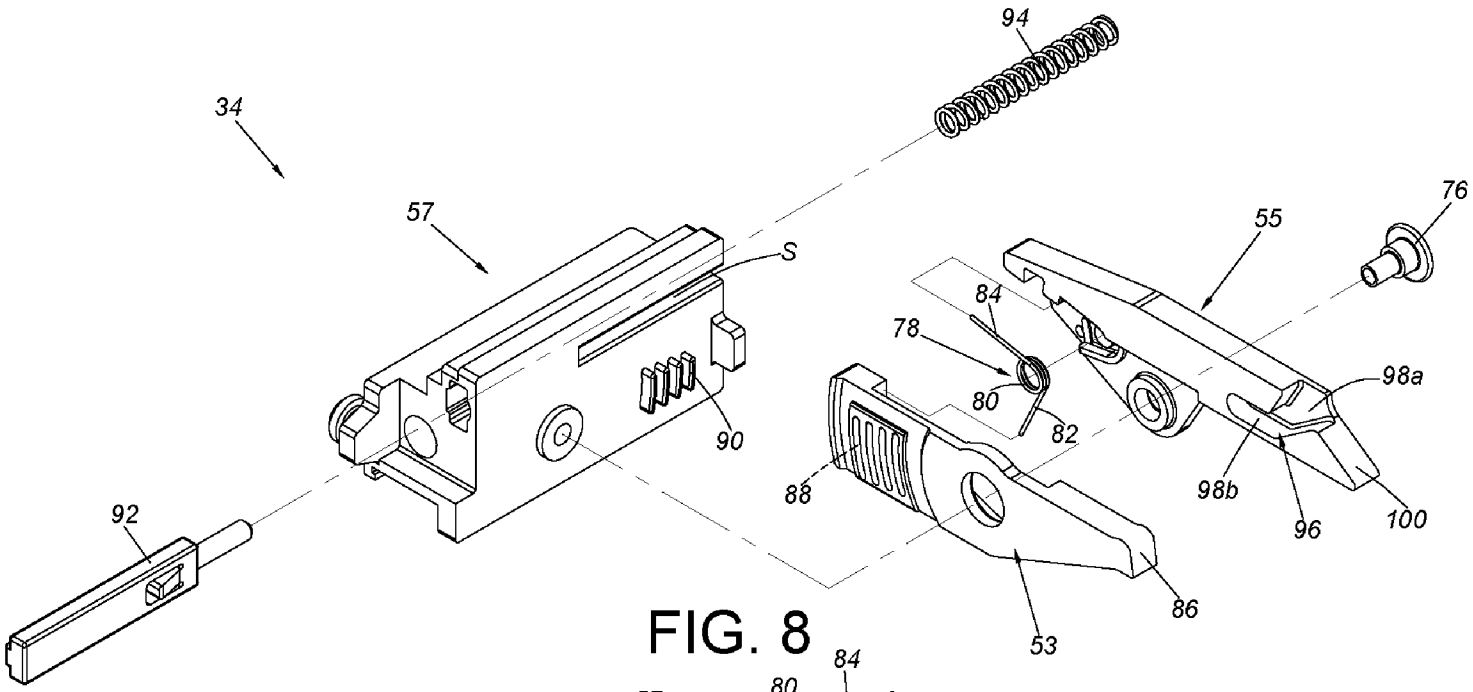
FIG. 8 is an explode view of a protection device according to an embodiment of the present invention.
Figure 9:
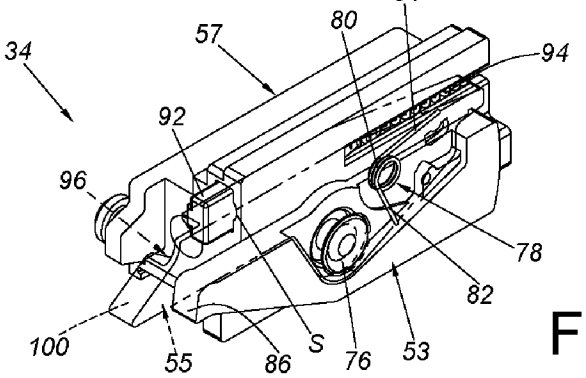
FIG. 9 is diagram showing the protection device according to an embodiment of the present invention.

As shown in FIG. 8 and FIG. 9, the blocking member 53 and the control member 55 of the protection device 34 are movable relative to the base 57. In the present embodiment, the blocking member 53 and the control member 55 are pivoted to the base 57 by a shaft member 76. Preferably, the protection device 34 further comprises an elastic member 78 configured to provide an elastic force to the blocking member 53 and the control member 55. For example, the elastic member 78 has a winding part 80, and a first elastic part 82 and a second elastic part 84 respectively located at two sides of the winding part 80. In addition, the first elastic part 82 and the second elastic part 84 are respectively mounted to the blocking member 53 and the control member 55.

The blocking member 53 comprises a blocking part 86. Preferably, one of the blocking member 53 and the base 57 comprises at least one accommodating room 88. In addition, the other one of the blocking member 53 and the base 57 comprises at least one rib 90. The at least one accommodating room 88 is configured to accommodate the at least one rib 90, and the at least one accommodating room is larger than the at least one rib 90. In the present embodiment, the blocking member 53 comprises the at least one accommodating room 88, and the base 57 comprises the at least one rib 90. Preferably, the driving mechanism further comprises an abutting member 92 mounted to the base 57, and an auxiliary elastic member 94 configured to provide an elastic force to the abutting member 92. Specifically, the base 57 has a mounting space S configured to accommodate the auxiliary elastic member 94, and the abutting member 92 can be partially extended out of the base 57 through the elastic force of the auxiliary elastic member 94.

The control member 55 comprises a second guiding feature 96. Specifically, the second guiding feature 96 is a passage. The passage comprises an inclined section 98*a* and a linear section 98*b* communicated with the inclined section 98*a*. In the present embodiment, the inclined section 98*a* is bent relative to the linear section 98*b*, and the linear section 98*b* is longitudinally arranged. Preferably, the control member 55 further has an inclined surface or an arc surface. In the present embodiment, the control member 55 has an inclined surface 100, but the present invention is not limited thereto.

Figure 10:
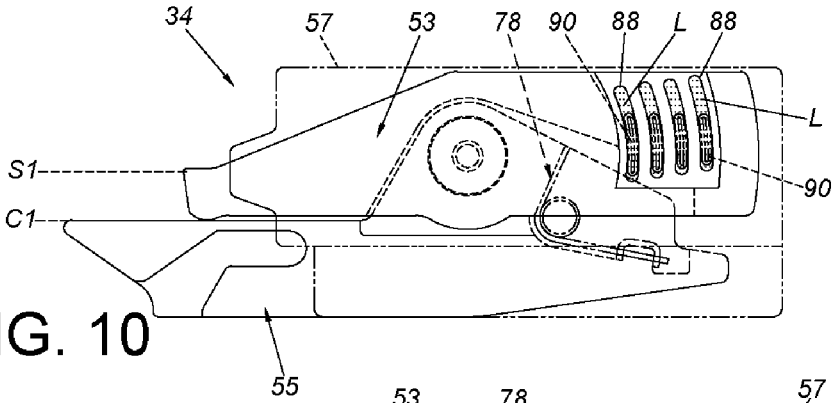
FIG. 10 is diagram showing the protection device being in a first state according to an embodiment of the present invention.

As shown in FIG. 10, the accommodating room 88 of the blocking member 53 of the protection device 34 is configured to accommodate the rib 90, and the accommodating room 88 is filled with a damping material L. (In FIG. 10 to FIG. 13, the damping material L is shown as a plurality of black dots.) For example, the damping material L can be liquid or oil. Preferably, the elastic member 78 provides an elastic force to the blocking member 53 and the control member 55. Furthermore, the blocking member 53 is in a first state S1 relative to the base 57, and the control member 55 is in a first control state C1 relative to the base 57.

Figure 11:
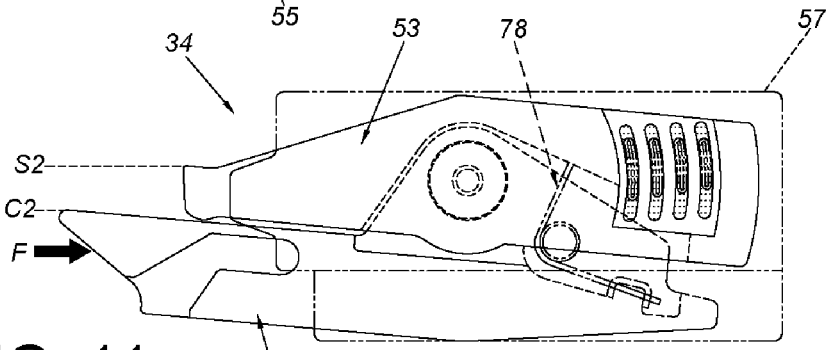
FIG. 11 is diagram showing the protection device being in a second state according to an embodiment of the present invention.

As shown in FIG. 11, when a force F is applied to the control member 55, the control member 55 is rotated relative to the base 57 to move from the first control state C1 to a second control state C2. On the other hand, the blocking member 53 is driven to rotate from the first state S1 to a second state S2 in response to the control member 55 being moved to the second control state C2. In the meantime, the elastic member 78 accumulates an elastic force.

Figure 12:
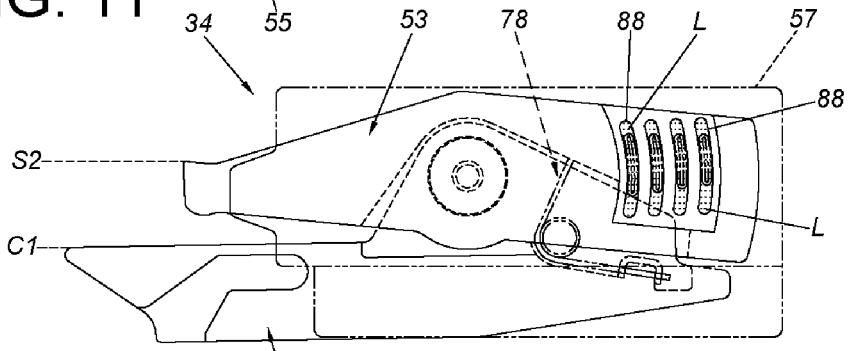
FIG. 12 is diagram showing the protection device being in a third state according to an embodiment of the present invention.
Figure 13:
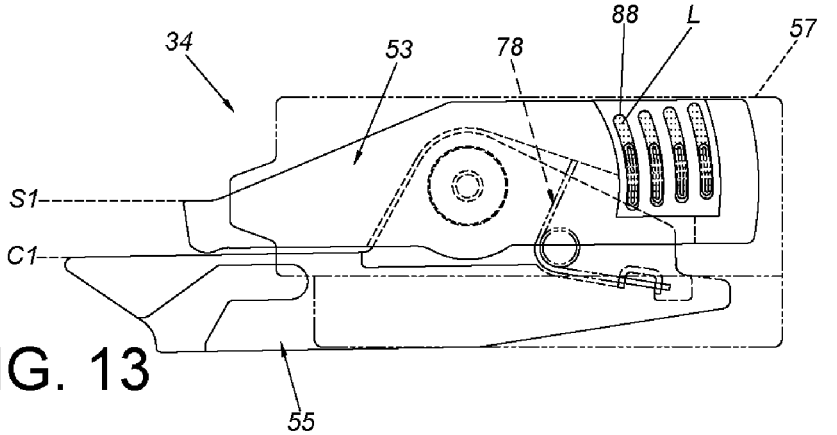
FIG. 13 is diagram showing the protection device returning to the first state according to an embodiment of the present invention.

As shown in FIG. 11, FIG. 12 and FIG. 13, when the force F applied to the control member 55 no longer exists, the control member 55 returns to the first control state C1 from the second control state C2 in response to the elastic force of the elastic member 78. Furthermore, during a process of the control member 55 returning to the first control state C1 from the second control state C2, since the accommodating room 88 of the blocking member 53 is filled with the damping material L, motion of the blocking member 53 moving from the second state S2 to the first state S1 is slowed down. In other words, the elastic force of the elastic member 78 applied to the blocking member 53 is mitigated.

Figure 14:
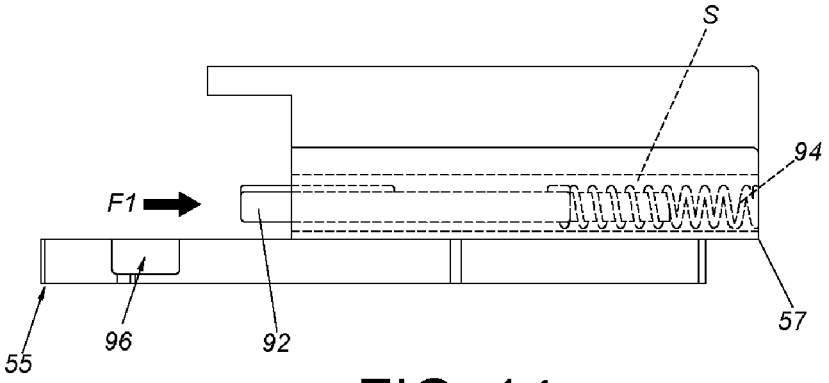
FIG. 14 is diagram showing arrangement of the protection device according to an embodiment of the present invention.
Figure 15:
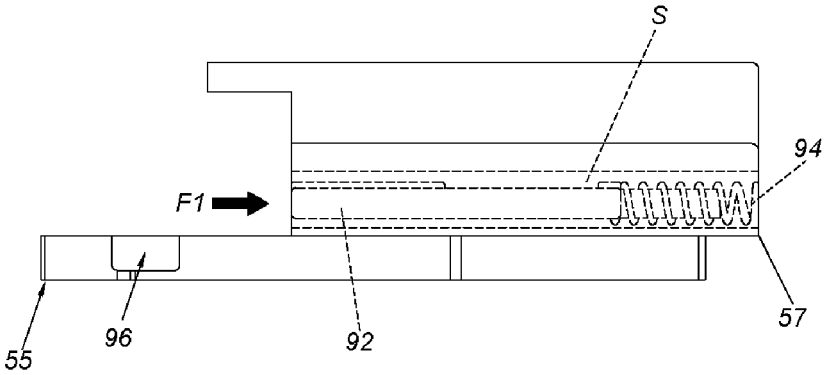
FIG. 15 is diagram showing the protection device being applied with an external force according to an embodiment of the present invention.

As shown in FIG. 14 and FIG. 15, when an external force F1 is applied to the abutting member 92, the abutting member 92 can be retracted into the mounting space S of the base 57 to push the auxiliary elastic member 94, such that the auxiliary elastic member 94 accumulates an elastic force.

Figure 16:
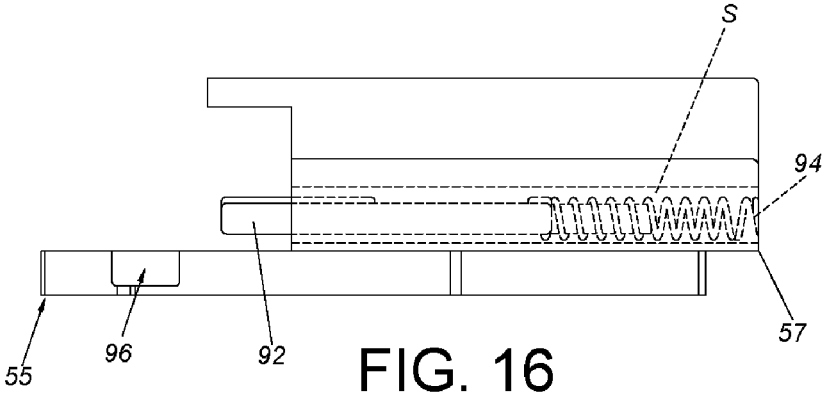
FIG. 16 is diagram showing the protection device releasing an elastic force according to an embodiment of the present invention.

As shown in FIG. 15 and FIG. 16, when the external force F1 no longer exists, the abutting member 94 can partially extend out of the base 57 once again in response to the elastic force of the auxiliary elastic member 94.

Figure 17:
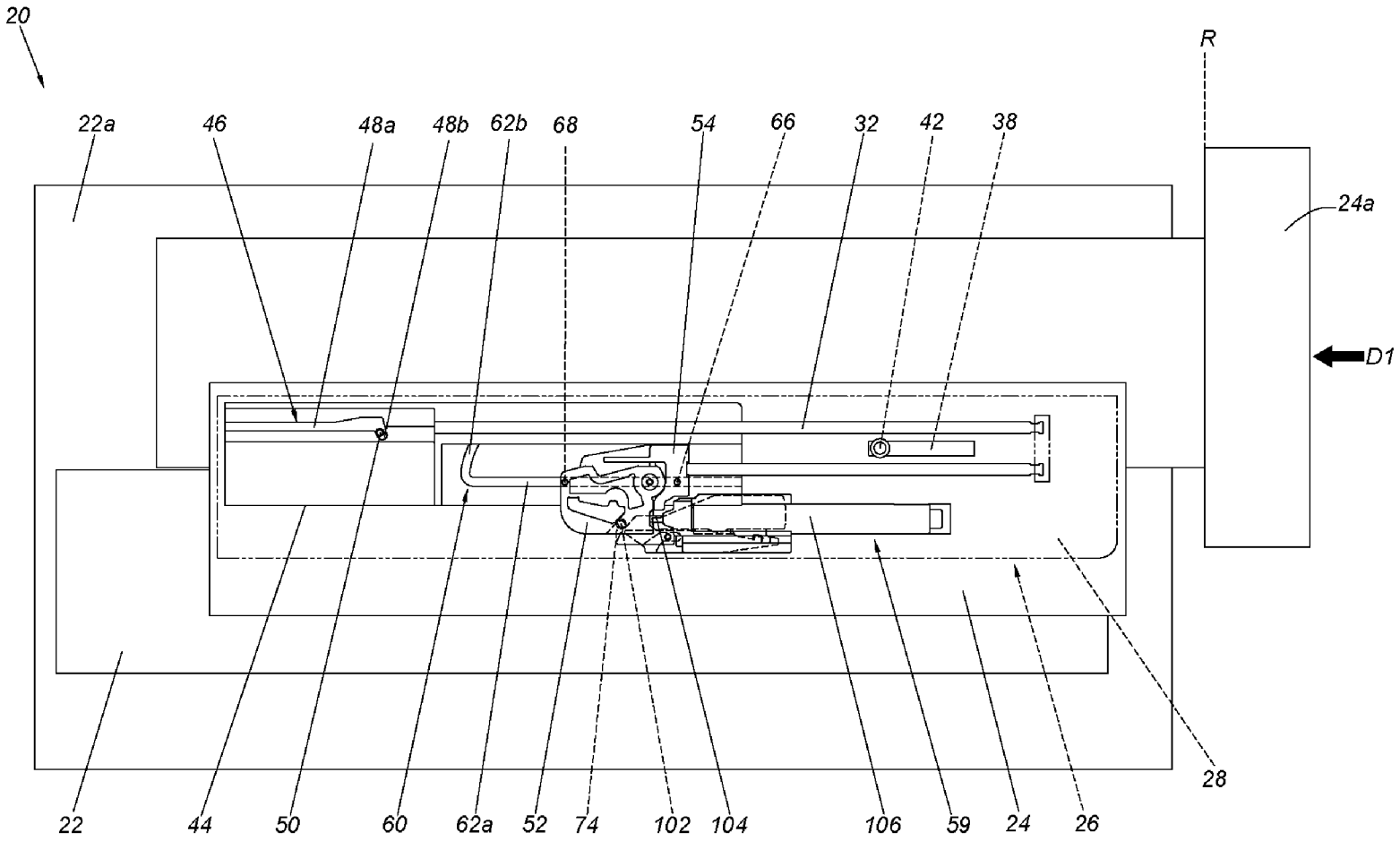
FIG. 17 is diagram showing the second furniture part of the furniture system being located at a close position according to an embodiment of the present invention.

As shown in FIG. 17, when the second furniture part 24 of the furniture system 20 is located at a close position R relative to the first furniture part 22 (that is, the drawer 24*a* is located at the close position R relative to the cabinet 22*a*), the actuating member 52 is configured to catch or engage with a fixed object 102 (such as a fixed pin) of the first furniture part 22 through the catching part 74. On the other hand, the second component 30 is configured to engage with the first bending section 48*b* of the first control part 46 of the mounting base 44 through the engaging feature 50 (FIG. 17 only shows the engaging feature 50 for presenting a position of the second component 30), in order to temporarily hold the open elastic member 32 to accumulate an opening force. Furthermore, the first supporting leg 66 of the supporting member 54 and the second supporting leg 68 of the actuating member 52 are respectively located within the second longitudinal section 62*a* of the second control part 60. A damping rod 104 of the damping device 59 is retracted relative to a cylinder 106.

Figure 18:
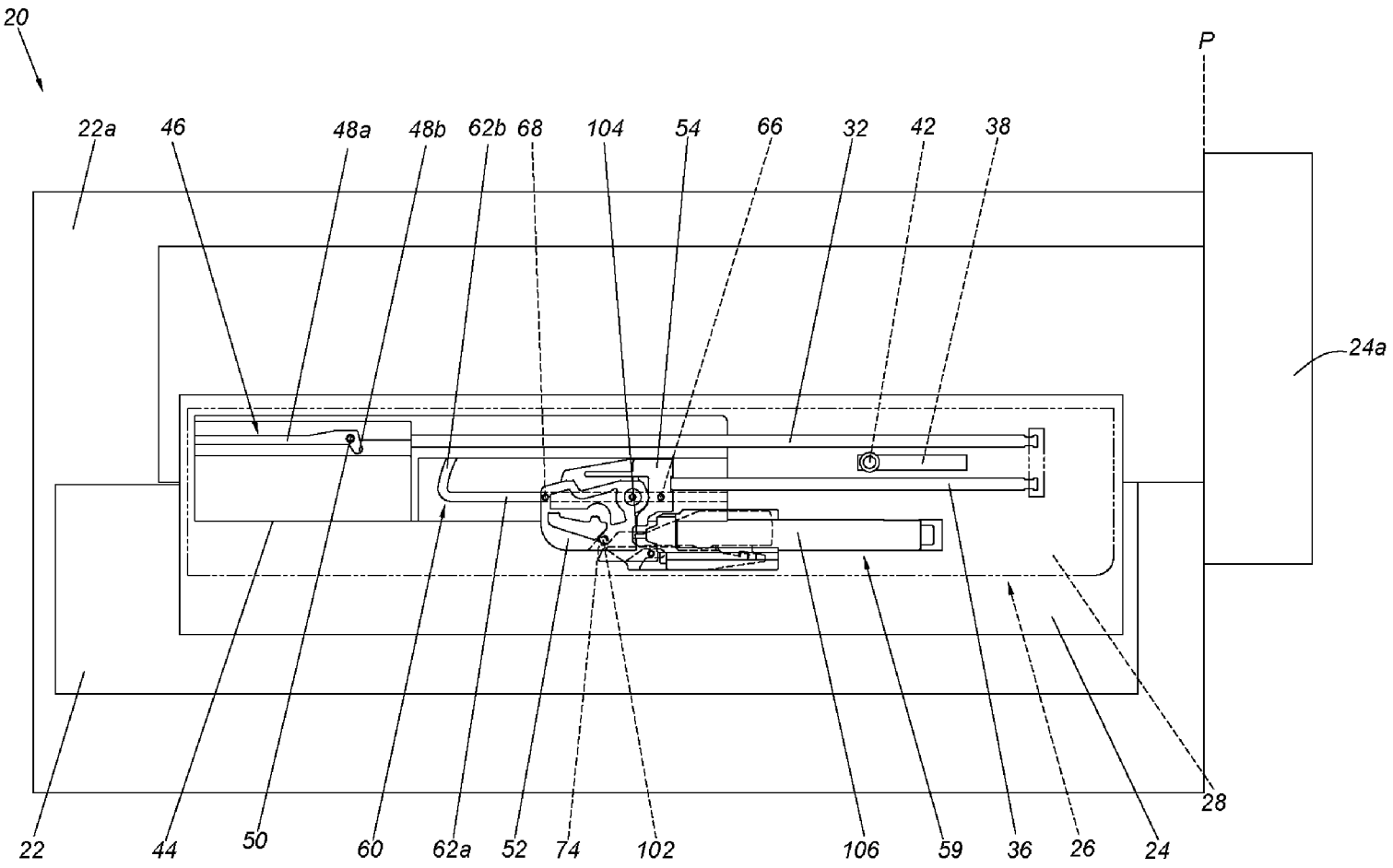
FIG. 18 is diagram showing the second furniture part of the furniture system being located at an over-push position according to an embodiment of the present invention.

As shown in FIG. 17 and FIG. 18, a user can push the second furniture part 24 to move relative to the first furniture part 22 from the close position R to an over-push position P along a first direction D1 (that is, the drawer 24*a* is located at the over-push position P relative to the cabinet 22*a*). When the second furniture part 24 is located at the over-push position P relative to the first furniture part 22, the open elastic member 32 is configured to provide the opening force. Preferably, the engaging feature 50 is disengaged from the first bending section 48*b* of the first control part 46 of the mounting base 44 to enter the first longitudinal section 48*a*, so as to allow the open elastic member 32 to release the opening force.

Figure 19:
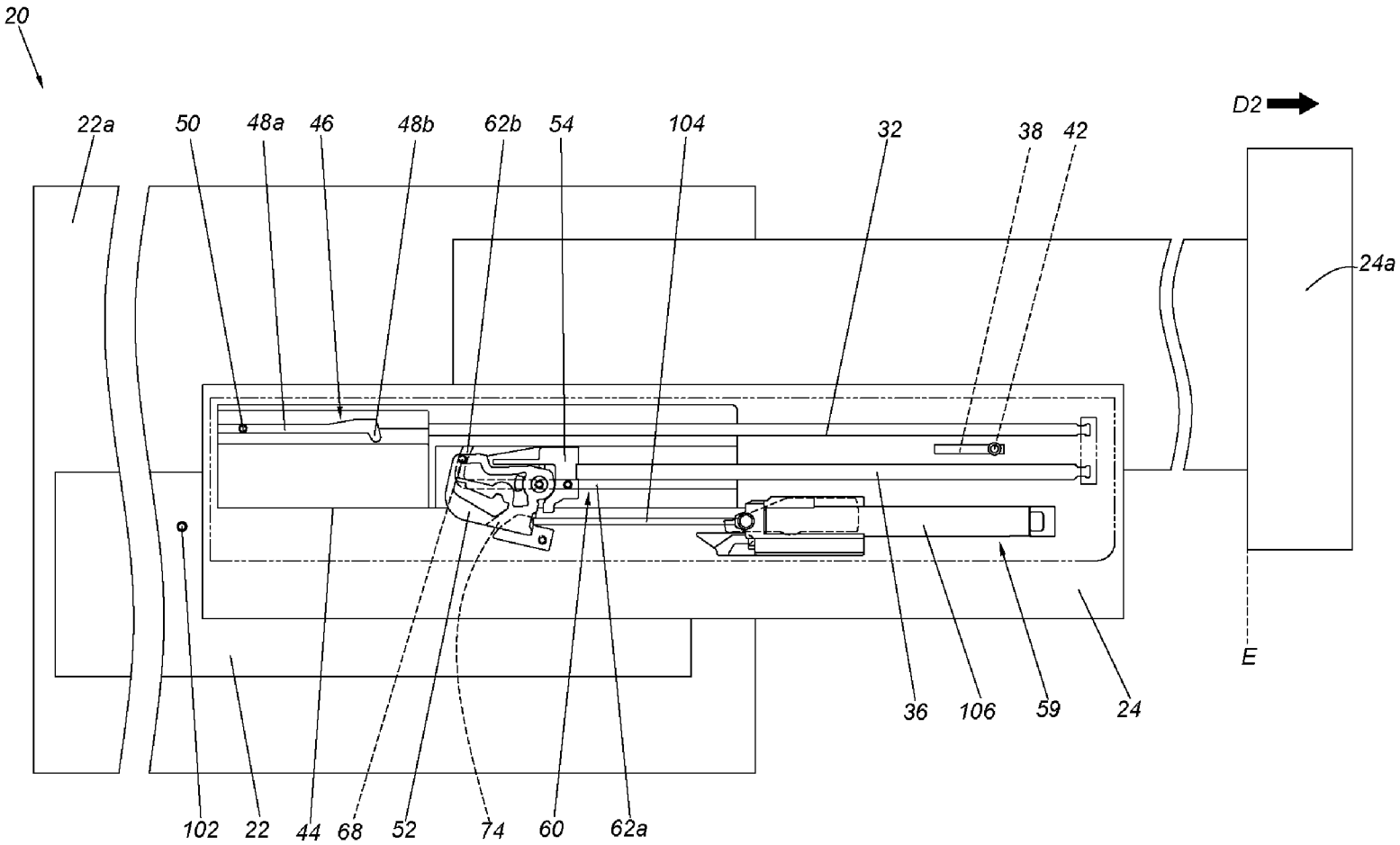
FIG. 19 is diagram showing the second furniture part of the furniture system being located at an open position according to an embodiment of the present invention.

As shown in FIG. 18 and FIG. 19, after the open elastic member 32 provides the opening force, the second furniture part 24 can be moved relative to the first furniture part 22 to an open position E along a second direction D2 opposite to the first direction D1 in response to the opening force (that is, the drawer 24*a* is located at the open position E relative to the cabinet 22*a*). Wherein, the second supporting leg 68 of the actuating member 52 further enters the second bending section 62*b* through the second longitudinal section 62*a* of the second control part 60, such that the actuating member 52 is deflected relative to the supporting member 54 to engage with the second bending section 62*b*, and the recovery elastic member 36 temporarily accumulate a closing force accordingly. Wherein, the catching part 74 of the actuating member 52 is detached from the fixed object 102 of the first furniture part 22 due to the actuating member 52 being deflected. In addition, the damping rod 104 of the damping device 59 extends out of the cylinder 106 to be in a damping ready state. Preferably, the damping rod 104 of the damping device 59 faces toward the actuating member 52 and/or the supporting member 54.

Figure 20:
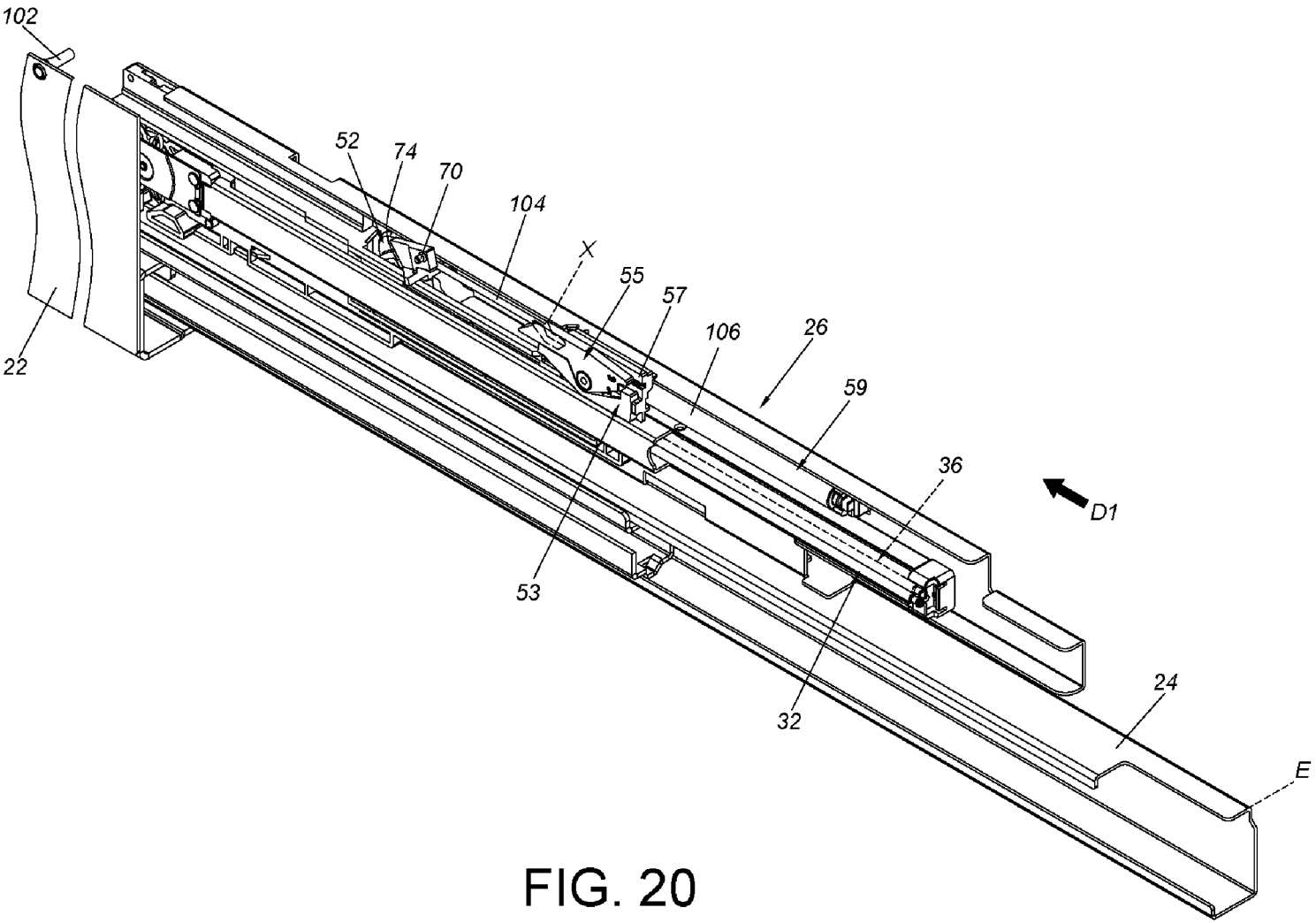
FIG. 20 is a diagram showing the second furniture part of the furniture system being closed relative to the first furniture part from the open position along a first direction according to an embodiment of the present invention.

As shown in FIG. 20, when the second furniture part 24 is located at the open position E relative to the first furniture part 22, the driving mechanism 26 is located at the open position E with the second furniture part 24. Wherein, the catching part 74 of the actuating member 52 is detached from the fixed object 102 of the first furniture part 22. In addition, the damping rod 104 of the damping device 59 extends out of the cylinder 106 to face toward the actuating member 52.

Figure 21:
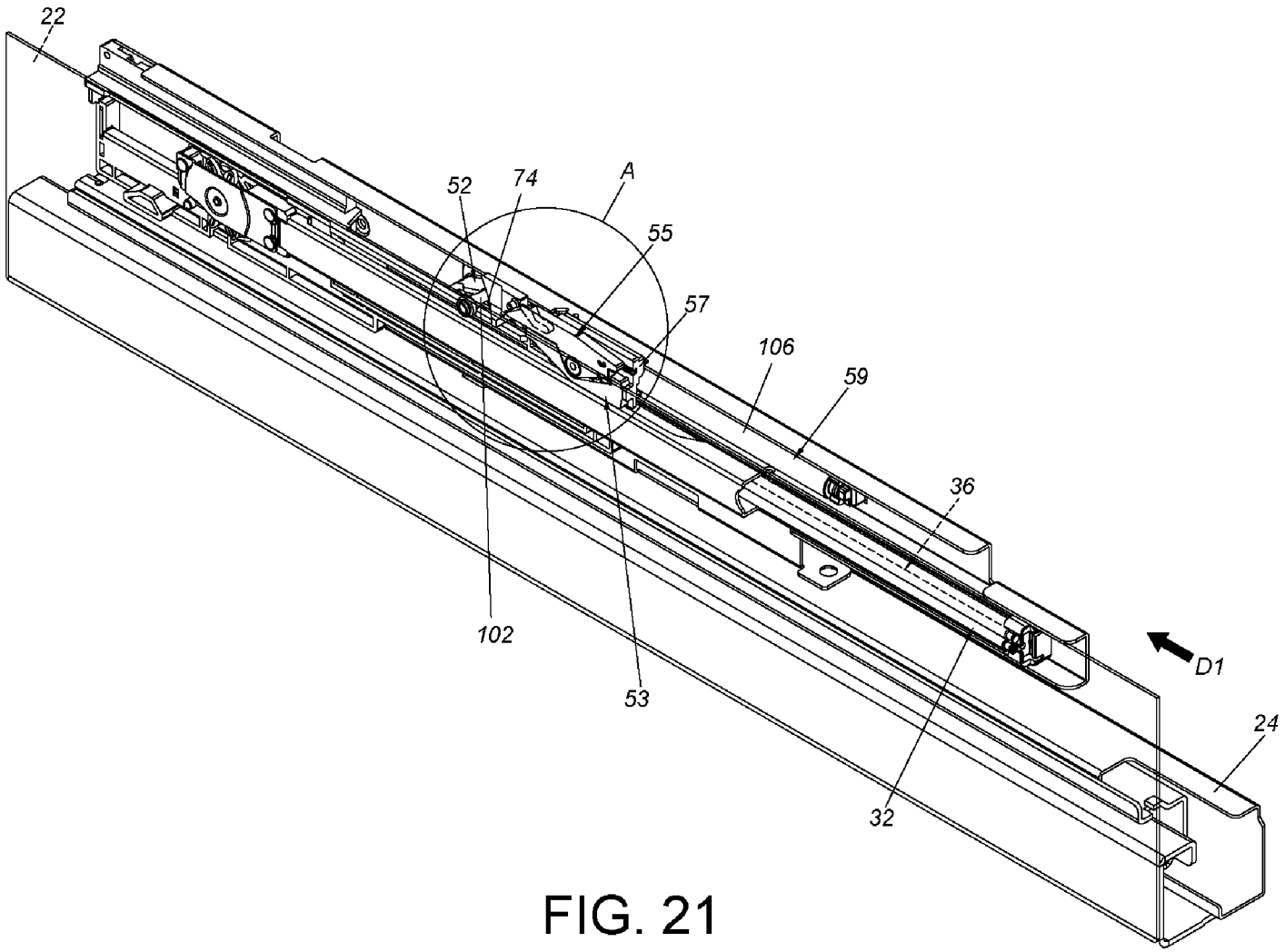
FIG. 21 is a diagram showing the second furniture part of the furniture system being further closed relative to the first furniture part from the open position along the first direction according to an embodiment of the present invention.

As shown in FIG. 20 and FIG. 21, during an end process of the second furniture part 24 being moved relative to the first furniture part 22 from the open position E to a position close to the close position R along the first direction D1, the actuating member 52 can catch the fixed object 102 of the first furniture part 22 once again through the catching part 74. As such, the actuating member 52 is deflected due to the second supporting leg 68 is moved from the second bending section 62*b* of the second control part 60 to the second longitudinal section 62*a*, in order to allow the recovery elastic member 36 to release the closing force.

Furthermore, the actuating member 52 and the control member 55 are movable relative to each other. In the present embodiment, since the actuating member 52 is temporarily fixed due to the catching part 74 catching the fixed object 102 of the first furniture part 22, the recovery elastic member 36 releases the closing force to the second furniture part 24 during the end process of the second furniture part 24 being moved relative to the first furniture part 22 toward the close position R. Wherein, due to the second furniture part 24 being moved toward the close position R, the base 57, the control member 55 and the blocking member 53 of the protection device 34 can be moved relative to the actuating member 52 from a predetermined position X along the first direction D1. In other words, the control member 55 and the actuating member 52 can be getting closer to each other. In such process, the actuating member 52 contacts the control member 55, and the damping rod 104 of the damping device 59 abuts against the actuating member 52, such that the damping rod 104 is retracted into the cylinder 106 to provide a damping effect.

Figure 22:
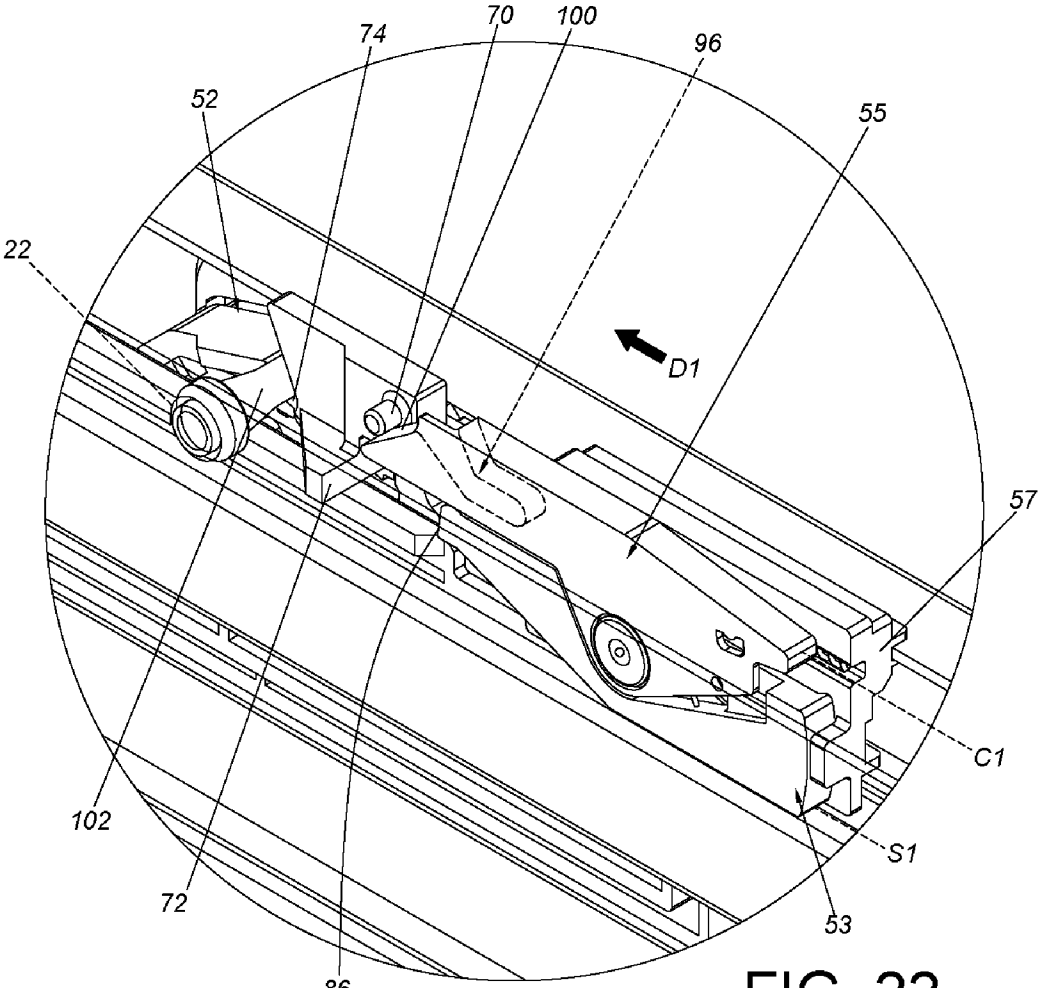
FIG. 22 is an enlarged view of an area A of FIG. 21 for showing the protection device contacting an actuating member, and a blocking member and a control member of the protection device being in a first state.

As shown in FIG. 22, when the actuating member 52 catches the fixed object 102 of the first furniture part 22 and the control member 55 is moved close to the actuating member 52 along the first direction D1, the actuating member 52 contacts the control member 55. Preferably, the first guiding feature 70 of the actuating member 52 contacts the inclined surface 100 of the control member 55, in order to guide the first guiding feature 70 of the actuating member 52 to enter the second guiding feature 96 of the control member 55. Wherein, the blocking member 53 is in the first state S1 relative to the base 57, and the control member 55 is in the first control state C1 relative to the base 57. Preferably, through the first guiding feature 70 of the actuating member 52 contacting the inclined surface 100 of the control member 55, the control member 55 is driven to move to be no longer in the first control state C1.

Figure 23:
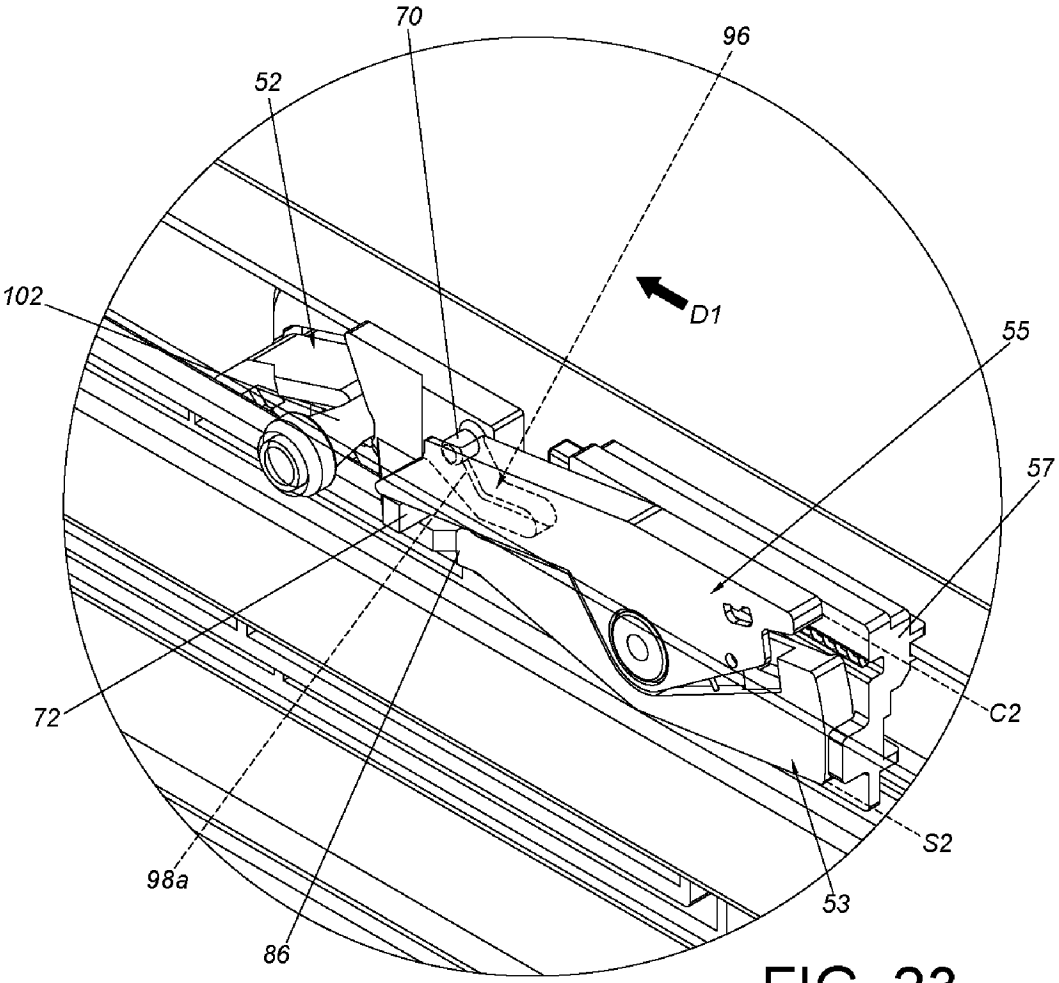
FIG. 23 is a diagram showing the blocking member and the control member of the protection device being in a second state according to an embodiment of the present invention.

As shown in FIG. 22 and FIG. 23, when the control member 55 is further moved close to the actuating member 52 along the first direction (that is, during the process of the second furniture part 24 being moved relative to the first furniture part 22 to the close position R along the first direction D1), the second guiding feature 96 of the control member 55 interacts with the first guiding feature 70. Specifically, the first guiding feature 70 of the actuating member 52 is guided to enter the inclined section 98*a* of the second guiding feature 96 of the control member 55, such that the control member 55 is driven by the actuating member 52 to move from the first control state C1 to the second control state C2. The blocking member 53 is further moved from the first state S1 to the second state S2 in response to the control member 55 being moved from the first control state C1 to the second control state C2. In the present embodiment, the first guiding feature 70 is a protrusion, and the second guiding feature 96 is a passage. However, in other embodiments, the first guiding feature 70 can be a passage, and the second guiding feature 96 can be a protrusion, but the present invention is not limited thereto.

Figure 24:
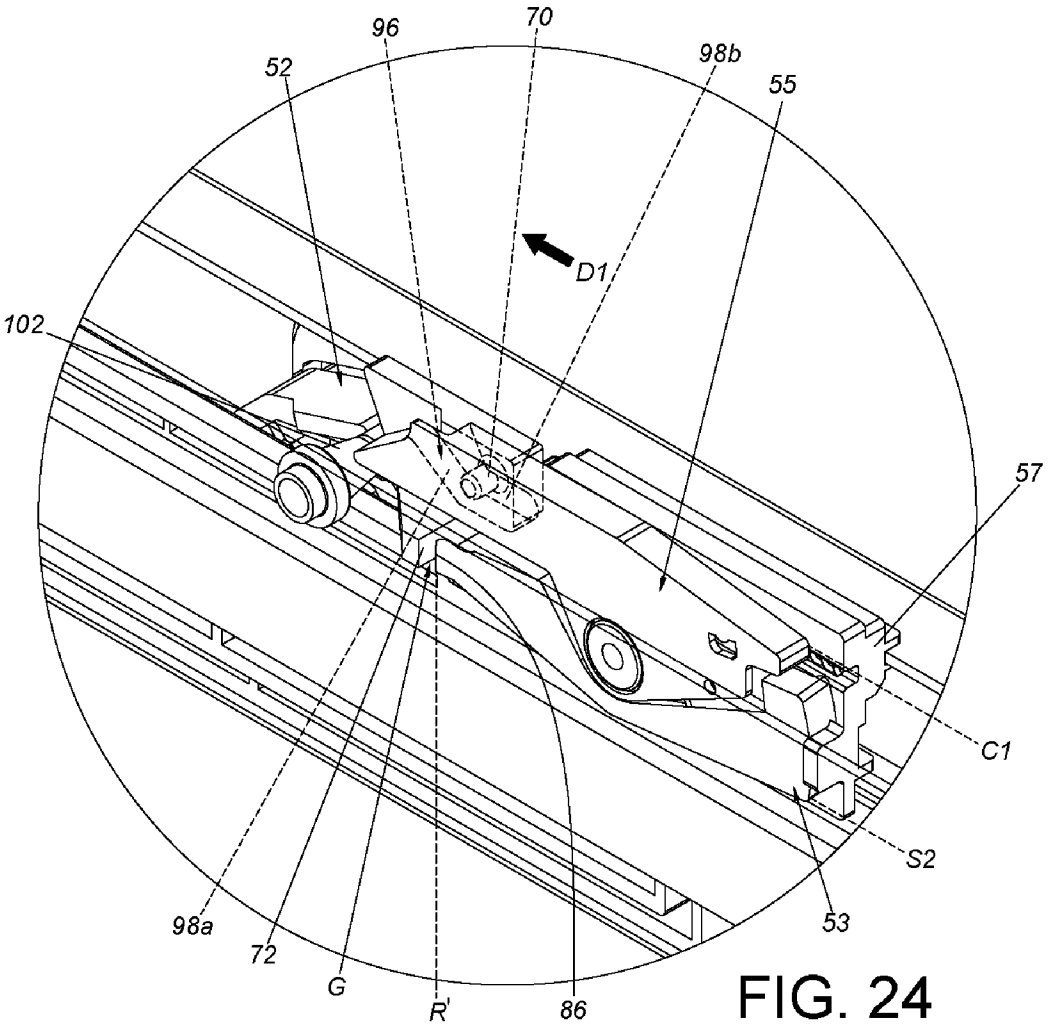
FIG. 24 is a diagram showing the blocking member and the control member of the protection device being in a third state according to an embodiment of the present invention.

As shown in FIG. 23 and FIG. 24, when the control member 55 is further moved closer to the actuating member 52 (that is, during the process of the second furniture part 24 being moved relative to the first furniture part 22 to the close position R along the first direction D1), the first guiding feature 70 of the actuating member 52 enters the linear section 98*b* of the second guiding feature 96 of the control member 55 from the inclined section 98*a*, and the control member 55 can return to the first control state C1 from the second control state C2 in response to the elastic force of the elastic member 78. Wherein, when the blocking member 53 is in the second state S2, and the control member 55 (and the blocking member 53 and the base 57) is moved relative to the actuating member 52 to a close position R' (the second furniture part 24 can be seen to be located at the close position R), the blocking feature 72 of the actuating member 52 is located at a position corresponding to the blocking part 86 of the blocking member 53 to block the blocking member 53, in order to prevent the control member 55 (and the blocking member 53 and the base 57) from being further moved relative to the actuating member 52 from the close position R' to an over-push position P' along the first direction D1. In other words, the second furniture part 24 is prevented from being moved from the close position R to the over-push position P. As such, the open elastic member 32 can be prevented from releasing the opening force.

Figure 25:
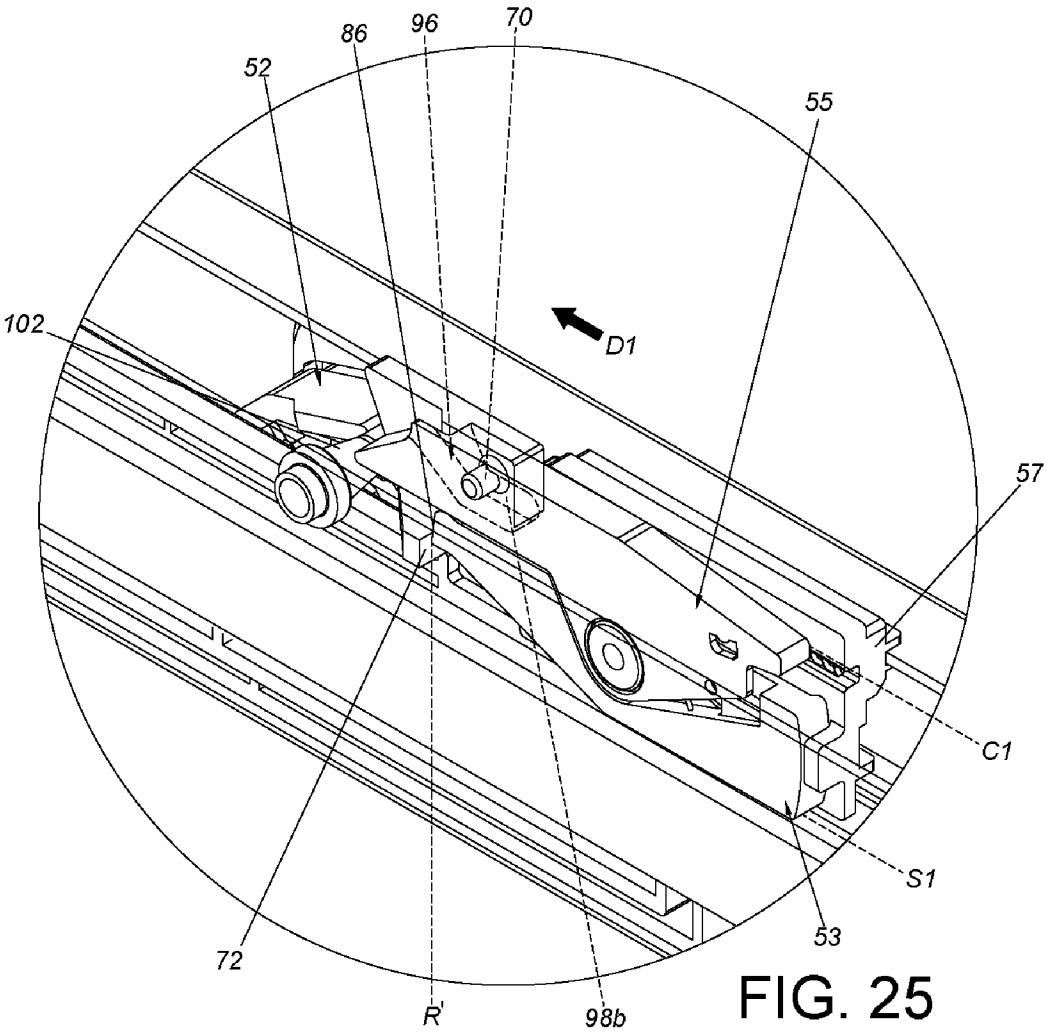
FIG. 25 is a diagram showing the blocking member and the control member of the protection device returning to the first state according to an embodiment of the present invention.

As shown in FIG. 24 and FIG. 25, the blocking member 53 is driven by the elastic force of the elastic member 78 to move from the second state S2 to the first state S1 a period of delay time after the control member 55 is moved to the first control state C1. Preferably, a gap G is formed between the blocking feature 72 of the actuating member 52 and the blocking part 86 of the blocking member 53 for assisting the blocking member 53 in moving from the second state S2 to the first state S1. When the blocking member 53 is in the first state S1, the blocking feature 72 of the actuating member 52 is no longer located at the position corresponding to the blocking part 86 of the blocking member 53 (the blocking feature 72 of the actuating member 52 no longer blocks the blocking part 86 of the blocking member 53), such that the control member 55 (and the blocking member 53 and the base 57) can be further moved relative to the actuating member 52 from the close position R' to the over-push position P' along the first direction D1. That is, the second furniture part 24 can be moved from the close position R to the over-push position P.

Figure 26:
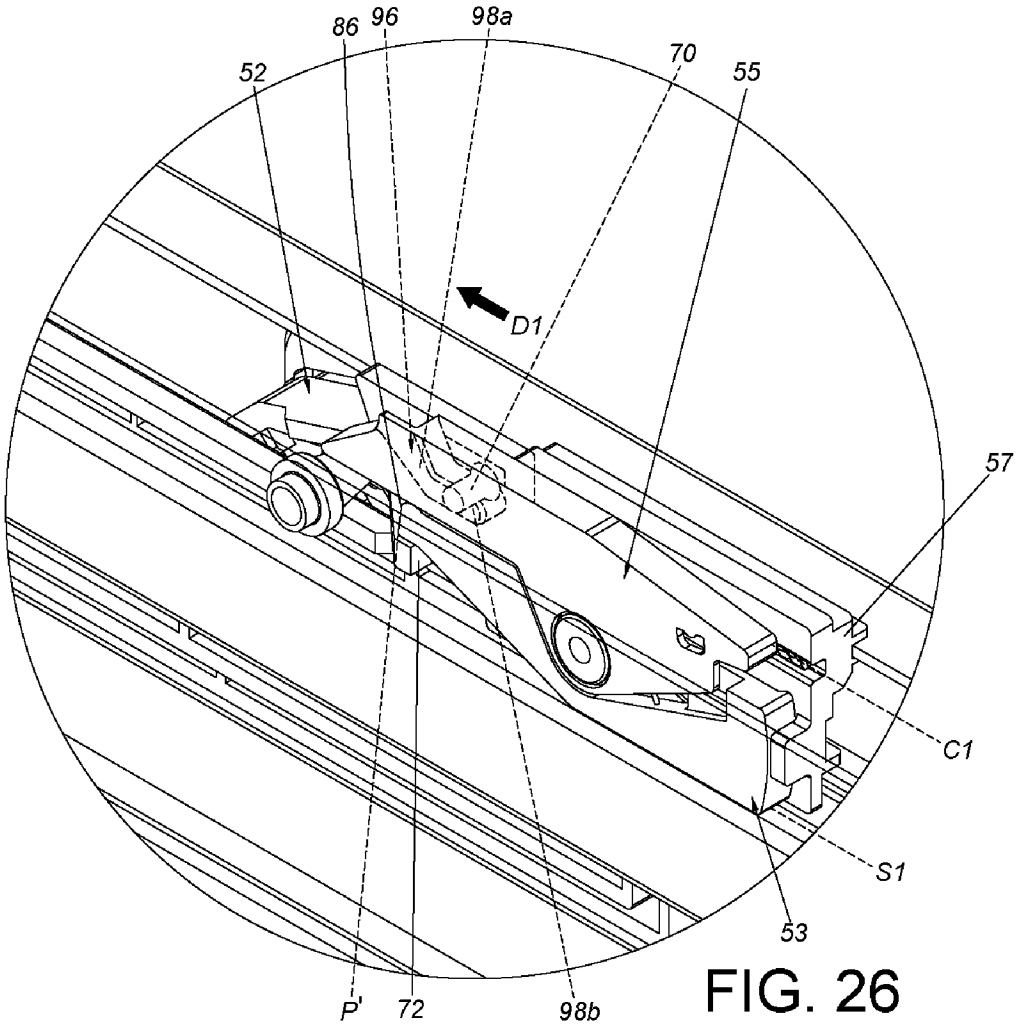
FIG. 26 is a diagram showing one of the actuating member and the control member of the protection device being located at the over-push position relative to the other one according to an embodiment of the present invention.

As shown in FIG. 25 and FIG. 26, when the control member 55 (and the blocking member 53 and the base 57) is moved relative to the actuating member 52 from the close position R' to the over-push position P' along the first direction D1 (that is, the second furniture part 24 is moved from the close position R toward the over-push position P along the first direction D1), the blocking part 86 of the blocking member 53 can pass by the blocking feature 72 of the actuating member 52, and the first guiding feature 70 of the actuating member 52 further enters the linear section 98*b* of the second guiding feature 96 of the control member 55. In other words, the second furniture part 24 can be moved from the close position R to the over-push position P along the first direction D1 in order to allow the open elastic member 32 to release the opening force. As such, the second furniture part 24 can be driven by the opening force to move to the open position E along the second direction D2. (Please also refer to FIG. 20. For simplicity, no further illustration is provided.)

Figure 27:
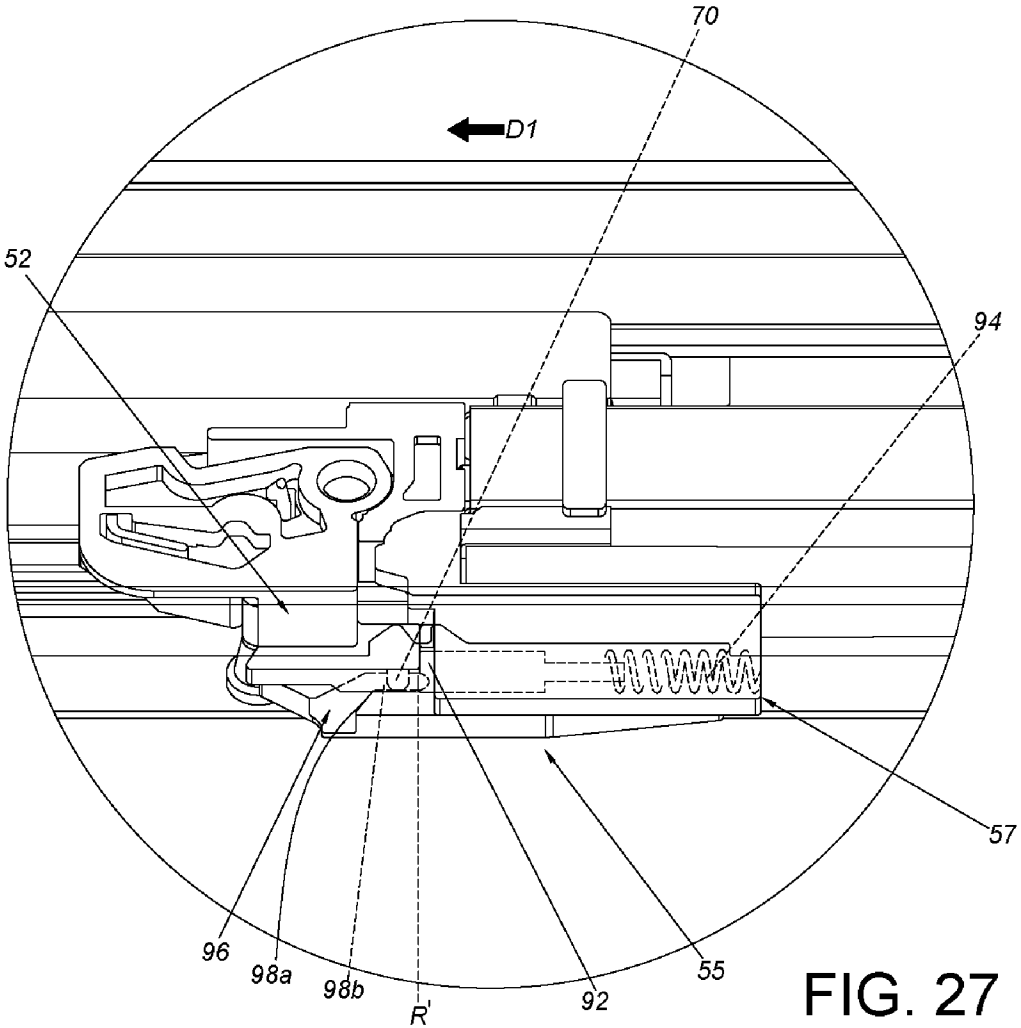
FIG. 27 is a diagram showing the actuating member contacting an abutting member of the protection device according to an embodiment of the present invention.

Preferably, as shown in FIG. 27, when the first guiding feature 70 of the actuating member 52 enters the linear section 98*b* from the inclined section 98*a* of the second guiding feature 96 a predetermined traveling distance, the blocking member 53 is in the second state S2, and the control member 55 (and the base 57) is moved to the close position R' relative to the actuating member 52 along the first direction D1. Wherein, the actuating member 52 and the abutting member 92 contact each other, in order to press the auxiliary elastic member 94 to accumulate an elastic force.

Figure 28:
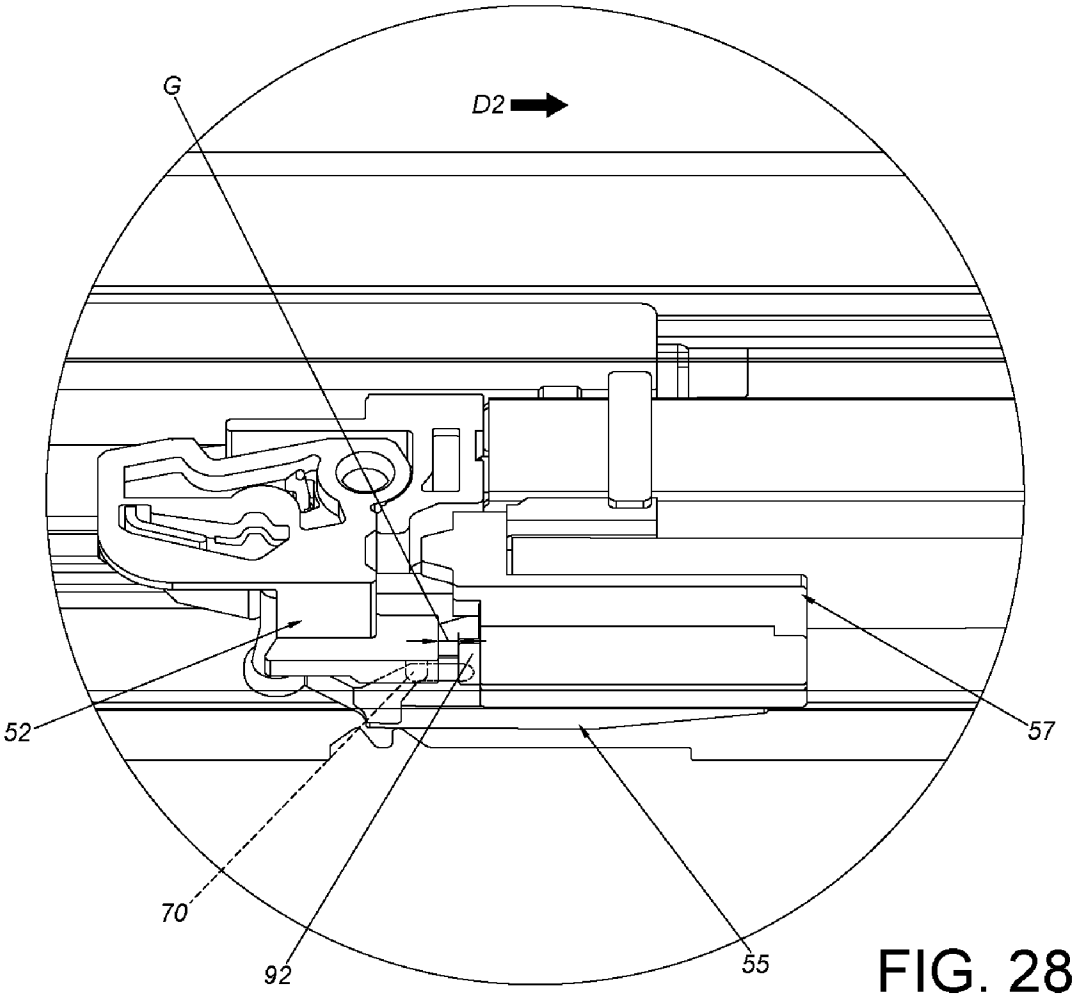
FIG. 28 is a diagram showing a gap formed between the actuating member and the abutting member of the protection device according to an embodiment of the present invention.

As shown in FIG. 27 and FIG. 28, when the auxiliary elastic member 94 releases the elastic force to the abutting member 92, a counterforce is correspondingly generated along the second direction D2, such that the gap G can be kept between the actuating member 52 and the blocking member 53 for assisting the blocking member 53 in moving from the second state S2 to the first state S1. (Please also refer to FIG. 24 and FIG. 25. For simplicity, no further illustration is provided.)

The present invention further provides a control method for the furniture system 20. The control method comprises the following steps:

Step S10: Provide the blocking member 53 and the control member 55 mounted to the base 57, wherein the blocking member 53 is movable between the first state S1 and the second state S2 relative to the base 57, and the control member 55 is movable the first control state C1 and the second control state S2 relative to the base 57;

Step S20: Provide the actuating member 52;

Step S30: Move the blocking member 53 from the first state S1 to the second state S2 to be blocked by the actuating member 52 when the second furniture part 24 is moved from the open position E toward the close position R along the first direction D1, in order to prevent the second furniture part 24 from being moved from the close position R to the over-push position P; and Step S40: Move the blocking member 53 from the second state S2 to the first state S1 without being blocked by the actuating member 52 a period of delay time after the actuating member 52 drives the control member 55 to move from the second control state C2 to the first control state C1, in order to allow the second furniture part 24 to be moved from the close position R to the over-push position P.

Therefore, the present invention is characterized in that:

1. When the second furniture part 24 is moved relative to the first furniture part 22 from the open position E to the close position R along the first direction D1, the protection device 34 can be used to prevent the second furniture part 24 from being further moved from the close position R to the over-push position P along the first direction D1, in order to prevent the open elastic member 32 from releasing the opening force. In other words, the second furniture part 24 can be prevented from being unintentionally opened relative to the first furniture part 22 along the second direction D2.

2. The blocking member 53 is correspondingly in the first state S1 or the second state S2 in response to the control member 55 being in the first control state C1 or the second control state C2, in order to allow the second furniture part 24 to be moved from the close position R to the over-push position P or prevent the second furniture part 24 from being moved from the close position R to the over-push position P.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A driving mechanism, applicable to a first furniture part and a second furniture part, the driving mechanism comprising:

an opening elastic member configured to provide an opening force when the second furniture part is moved relative to the first furniture part from a close position to an over-push position along a first direction, in order to drive the second furniture part to move to an open position along a second direction opposite to the first direction;

an actuating member; and a protection device configured to interact with the actuating member, the protection device comprising:

a base;

a blocking member mounted to the base and movable between a first state and a second state relative to the base;

a control member mounted to the base and movable between a first control state and a second control state relative to the base; and an elastic member configured to provide an elastic force to the control member and the blocking member;

wherein during a process of the second furniture part being moved relative to the first furniture part from the open position to the close position along the first direction, the actuating member is configured to drive the control member to move from the first control state to the second control state, and the blocking member is driven by the control member to move from the first state to the second state to be blocked by the actuating member, in order to prevent the second furniture part from being moved from the close position to the over-push position;

wherein when the control member is switched from the second control state to the first control state, the blocking member is driven by the elastic member to move from the second state to the first state without being blocked by the actuating member, in order to allow the second furniture part to be moved from the close position to the over-push position.

2. The driving mechanism of claim 1, wherein the blocking member and the control member are pivoted to the base.

3. The driving mechanism of claim 2, wherein one of the base and the blocking member has an accommodating room, and the accommodating room is filled with a damping material for slowing down motion of the blocking member moving from the second state to the first state.

4. The driving mechanism of claim 3, wherein the other one of the base and the blocking member comprises at least one rib, the accommodating room is configured to accommodate the at least one rib.

5. The driving mechanism of claim 3, further comprising a recovery elastic member, wherein the actuating member comprises a first guiding feature, and the control member comprises a second guiding feature; during an end process of the second furniture part being moved relative to the first furniture part from the open position to a position close to the close position along the first direction, the recovery elastic member is configured to provide a closing force to drive the second furniture part to move toward the close position, and the control member is moved from the first control state to the second control state through interaction between the first guiding feature and the second guiding feature.

6. The driving mechanism of claim 5, further comprising a damping device configured to provide damping effect during the end process of the second furniture part being moved toward the close position, wherein one of the first guiding feature and the second guiding feature is a protrusion, and the other one of the first guiding feature and the second guiding feature is a passage, the passage has an inclined section and a linear section communicated with the inclined section.

7. The driving mechanism of claim 6, further comprising an abutting member mounted to the base, and an auxiliary elastic member configured to provide an elastic force to the abutting member; wherein when the protrusion enters the linear section a predetermined traveling distance from the inclined section of the passage, the actuating member is configured to contact the abutting member.

8. The driving mechanism of claim 5, wherein the control member further has one of an inclined surface and an arc surface; during the process of the second furniture part being moved relative to the first furniture part from the open position to the closed position along the first direction, the actuator member is configured to contact one of the inclined surface and the arc surface through the first guiding feature.

9. A protection device, applicable to a furniture system, the protection device comprising:

a base;

a blocking member mounted to the base and movable between a first state and a second state relative to the base;

a control member mounted to the base and movable between a first control state and a second control state relative to the base; and an elastic member configured to provide an elastic force to the control member and the blocking member;

wherein during a process of the protection device being moved relative to an actuating member of the furniture system from a predetermined position to a close position along a predetermined direction, the actuating member is configured to drive the control member to move from the first control state to the second control state, and the blocking member is driven by the control member to move from the first state to the second state to be blocked by the actuating member, in order to prevent the protection device from being moved relative to the actuating member from the close position to an over-push position along the predetermined direction;

wherein when the control member is moved from the second control state to the first control state, the blocking member is driven by the elastic member to move from the second state to the first state without being blocked by the actuating member, in order to allow the protection device to be moved relative to the actuating member from the close position to the over-push position along the predetermined direction.

10. The protection device of claim 9, wherein the blocking member and the control member are pivoted to the base.

11. The protection device of claim 10, wherein one of the base and the blocking member has an accommodating room, and the accommodating room is filled with a damping material for slowing down motion of the blocking member moving from the second state to the first state.

12. The protection device of claim 11, wherein the other one of the base and the blocking member comprises at least one rib, the accommodating room is configured to accommodate the at least one rib.

13. The protection device of claim 11, wherein the actuating member comprises a first guiding feature, and the control member comprises a second guiding feature; during the process of the protection device being moved relative to the actuating member from the predetermined position to the close position, the control member is moved from the first control state to the second control state through interaction between the first guiding feature and the second guiding feature.

14. The protection device of claim 13, wherein one of the first guiding feature and the second guiding feature is a protrusion, and the other one of the first guiding feature and the second guiding feature is a passage, the passage has an inclined section and a linear section communicated with the inclined section.

15. The protection device of claim 14, further comprising an abutting member mounted to the base, and an auxiliary elastic member configured to provide an elastic force to the abutting member; wherein when the protrusion enters the linear section a predetermined traveling distance from the inclined section of the passage, the actuator member is configured to contact the abutting member.

16. A control method for a furniture system, the furniture system comprising a first furniture part, a second furniture part and an open elastic member, the second furniture part configured to be moved relative to the first furniture part from a close position to an over-push position along a first direction, in order to allow the open elastic member to release an opening force to drive the second furniture part to move to an open position along a second direction opposite to the first direction, the control method comprising:

providing a blocking member and a control member mounted to a base, the blocking member being movable between a first state and a second state relative to the base, the control member being movable between a first control state and a second control state relative to the base;

providing an actuating member;

moving the blocking member from the first state to the second state to be blocked by the actuating member when the second furniture part is moved from the open position toward the close position along the first direction, in order to prevent the second furniture part from being moved from the close position to the over-push position; and moving the blocking member from the second state to the first state without being blocked by the actuating member a period of delay time after the actuating member drives the control member to move from the second control state to the first control state, in order to allow the second furniture part to be moved from the close position to the over-push position.

* * * * *